US010411397B2

(12) United States Patent
Haberek et al.

(10) Patent No.: US 10,411,397 B2
(45) Date of Patent: Sep. 10, 2019

(54) CONNECTOR SEAL DEVICE

(71) Applicant: PPC Broadband, Inc., East Syracuse, NY (US)

(72) Inventors: Andrew Haberek, Baldwinsville, NY (US); Christopher P. Natoli, Fulton, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 38 days.

(21) Appl. No.: 15/683,633

(22) Filed: Aug. 22, 2017

(65) Prior Publication Data

US 2018/0076563 A1 Mar. 15, 2018

Related U.S. Application Data

(63) Continuation of application No. 15/269,958, filed on Sep. 19, 2016, now Pat. No. 9,742,102, which is a continuation of application No. 14/212,356, filed on Mar. 14, 2014, now Pat. No. 9,450,329.

(60) Provisional application No. 61/790,389, filed on Mar. 15, 2013.

(51) Int. Cl.
*H01R 13/52* (2006.01)
*H01R 9/05* (2006.01)
*H01R 103/00* (2006.01)

(52) U.S. Cl.
CPC ..... *H01R 13/5219* (2013.01); *H01R 9/0521* (2013.01); *H01R 2103/00* (2013.01)

(58) Field of Classification Search
USPC ..... 439/277
See application file for complete search history.

(56) References Cited

U.S. PATENT DOCUMENTS 4,531,805 A 7/1985 Werth
4,789,343 A 12/1988 Dougherty et al.
4,954,105 A 9/1990 Fischer
5,454,675 A * 10/1995 DeHaitre ..... F16B 33/004 411/303
5,458,507 A 10/1995 Colescott et al.
(Continued)

FOREIGN PATENT DOCUMENTS

EP 2083492 A2 7/2009
WO 00/14829 A1 3/2000
(Continued)

OTHER PUBLICATIONS

Feb. 8, 2016 Office Action Issued in U.S. Appl. No. 14/212,356.
(Continued)

*Primary Examiner* — Alexander Gilman
(74) *Attorney, Agent, or Firm* — Oliff PLC

(57) ABSTRACT

A connector seal device includes, in one embodiment, a seal body extendable along an axis and configured to receive an end of a coupler. The coupler is configured to be rotatably coupled to a coaxial cable connector, and the seal body is configured to engage a portion of the coupler to establish a first environmental seal between the seal body and the coupler. The connector seal device also includes a seal neck integral with the seal body configured to extend along the axis beyond the end of the coupler. The seal neck is configured to engage an interface port to establish a second environmental seal between the seal neck and the interface port.

20 Claims, 29 Drawing Sheets

(56) References Cited

U.S. PATENT DOCUMENTS

| | | | | |
|---|---|---|---|---|
| 6,071,144 | A | 6/2000 | Tang | |
| 6,351,593 | B1 | 2/2002 | Pollack et al. | |
| D456,363 | S * | 4/2002 | Lee | D13/154 |
| 7,097,500 | B2 * | 8/2006 | Montena | H01R 9/05 439/587 |
| 7,186,127 | B2 * | 3/2007 | Montena | H01R 9/05 411/428 |
| 7,216,426 | B2 * | 5/2007 | Borgstrom | H01R 13/5216 174/73.1 |
| D549,178 | S * | 8/2007 | Amidon | D13/151 |
| D549,179 | S * | 8/2007 | Amidon | D13/151 |
| 7,264,503 | B2 * | 9/2007 | Montena | H02G 3/0675 439/585 |
| 7,402,063 | B2 | 7/2008 | Montena | |
| D575,744 | S * | 8/2008 | Amidon | D13/156 |
| 7,500,874 | B2 * | 3/2009 | Montena | H01R 4/70 439/587 |
| D607,827 | S * | 1/2010 | Shaw | D13/133 |
| 7,717,725 | B2 | 5/2010 | Montena | |
| 7,736,181 | B1 | 6/2010 | Benevento et al. | |
| D642,538 | S * | 8/2011 | Montena | H01R 13/5213 D13/156 |
| 8,246,371 | B2 | 8/2012 | Emerson | |
| D711,328 | S * | 8/2014 | Purdy | D13/156 |
| 2008/0310796 | A1 | 12/2008 | Lu | |
| 2009/0191752 | A1 | 7/2009 | Montena | |
| 2010/0233902 | A1 * | 9/2010 | Youtsey | H01R 24/40 439/578 |
| 2011/0117776 | A1 | 5/2011 | Burris et al. | |
| 2011/0143586 | A1 * | 6/2011 | Ehret | H01R 13/622 439/584 |
| 2011/0165786 | A1 | 7/2011 | Emerson | |
| 2012/0003869 | A1 * | 1/2012 | Ehret | H01R 13/622 439/578 |
| 2012/0065625 | A1 | 3/2012 | Nelson | |
| 2012/0129390 | A1 * | 5/2012 | Van Swearingen | B23K 20/10 439/578 |
| 2012/0196476 | A1 | 8/2012 | Haberek et al. | |
| 2013/0029513 | A1 * | 1/2013 | Montena | H01R 9/0524 439/345 |
| 2014/0273615 | A1 * | 9/2014 | Haberek | H01R 13/5219 439/519 |

FOREIGN PATENT DOCUMENTS

| | | | |
|---|---|---|---|
| WO | 03/058314 | A1 | 7/2003 |
| WO | 2010022123 | A1 | 2/2010 |

OTHER PUBLICATIONS

PCT/US14/28860; International Filing Date Mar. 14, 2014, International Search Report and Written Opinion, dated Jul. 31, 2014; (9 pages).

* cited by examiner

CONNECTOR SEAL DEVICE

PRIORITY CLAIM

This application is a continuation of U.S. application Ser. No. 15/269,958, filed on Sep. 19, 2016, which is a continuation of U.S. application Ser. No. 14/212,356, filed on Mar. 14, 2014, now U.S. Pat. No. 9,450,329, which is a non-provisional application that claims the benefits of priority of U.S. Provisional Application No. 61/790,389, filed on Mar. 15, 2013. The entire contents of such applications are hereby incorporated by reference.

INCORPORATION BY REFERENCE

The entire contents of the following are hereby incorporated into this application by reference: (a) U.S. Pat. No. 7,097,500, issued on Aug. 29, 2006; (b) U.S. Pat. No. 7,186,127, issued on Mar. 6, 2007; (c) U.S. Pat. No. 7,402,063, issued on Jul. 22, 2008; and (d) U.S. Pat. No. 7,500,874, issued on Mar. 10, 2009.

BACKGROUND

Connectors for coaxial cables are typically connected onto complementary interface ports to electrically integrate coaxial cables to various electronic devices. In some instances, the coaxial cable connectors are installed outdoors, exposed to weather and other numerous environmental elements. Weathering and various environmental elements can work to create interference problems when metallic conductive connector components corrode, rust, deteriorate or become galvanically incompatible, thereby resulting in intermittent contact, poor electromagnetic shielding, and degradation of the signal quality. Existing seals have their own drawbacks including, but not limited to, the high cost of manufacture, complexity, labor intensity for proper installation, low reliability and the like.

Accordingly, there is a need to overcome, or otherwise lessen the effects of, the disadvantages and shortcomings described above.

SUMMARY

The present disclosure relates to a connector seal device used, in one embodiment, with coaxial cable connectors. A first general aspect relates to a connector seal device comprising: a seal body extendable along an axis and configured to receive a forward end of a coupler, wherein the coupler is configured to be rotatably coupled to a coaxial cable connector. The seal body is configured to engage a portion of the coupler to establish a first environmental seal between the seal body and the coupler. A seal neck, integral with the seal body, is configured to extend along the axis beyond the end of the coupler to engage an interface port so as to establish a second environmental seal between the seal neck and the interface port.

A second general aspect relates to seal member having a unitary structured seal body. The seal body is extendable along an axis and is configured to receive an end of a coupler. The seal body is configured to apply a radial force acting on the coupler to establish a first environmental seal between the seal body and the coupler. A retention portion of the seal body has an interior surface having an irregularity configured to mate with an irregularity on the coupler. The seal body includes a tactile characteristic to facilitate rotation of the coupler by gripping the seal body. The seal body includes a seal neck configured to extend along the axis beyond the end of the coupler. The seal neck is flexible and has an interior surface configured to engage an interface port so as to establish a second environmental seal between the seal neck and the interface port.

A third general aspect relates to a cable connector seal assembly including a coupling member configured to engage an interface port, the coupling member having a seal retention portion proximate the forward end of the coupling member. The seal retention portion comprises an irregular exterior surface. A seal member having a unitary structure is disposed around the exterior surface of the seal retention portion and exerts a sealing force that is biased against the exterior surface in an inward radial direction to frictionally engage the retention portion. A forward portion of the seal member is configured to surround and seal the coaxial cable interface port to establish an environmental seal when the coupling member is mechanically engaged with the coaxial cable interface port.

Additional features and advantages of the present disclosure are described in, and will be apparent from, the following Brief Description of the Drawings and Detailed Description.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1A:
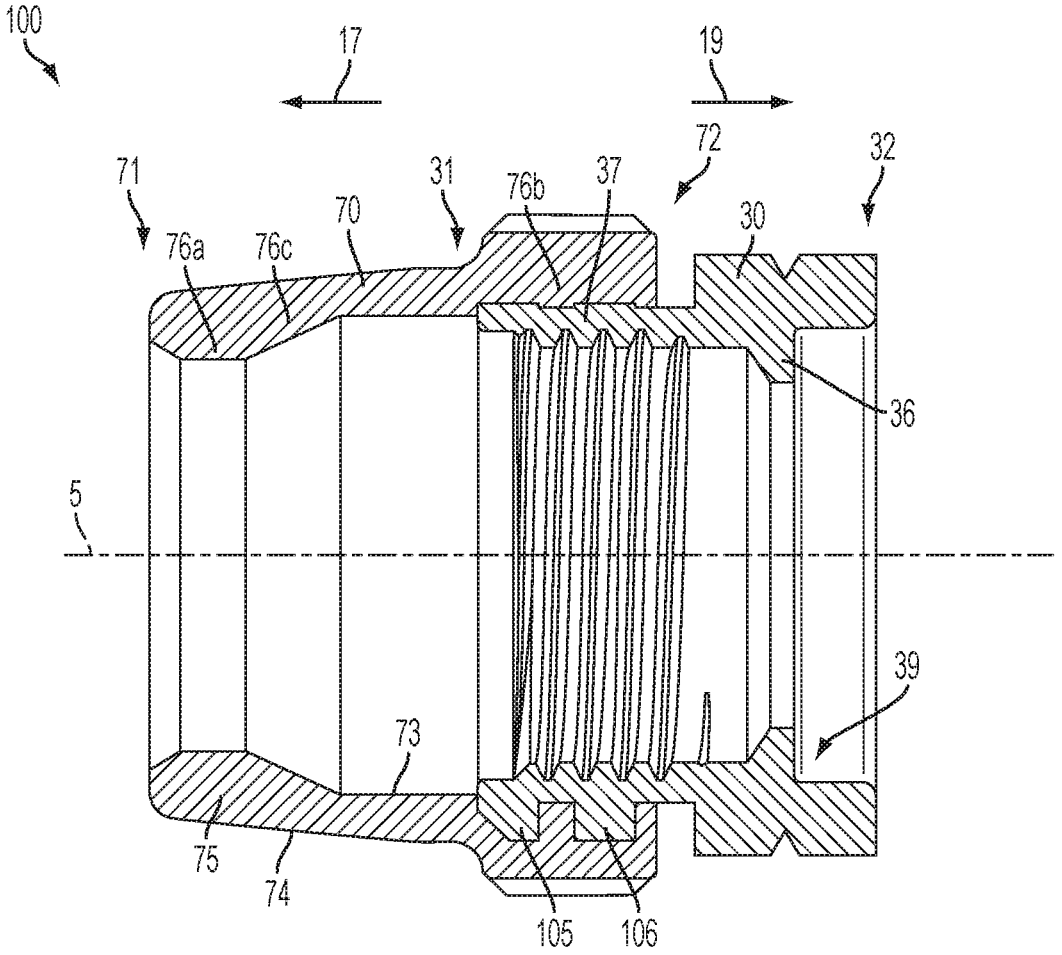
FIG. 1A depicts a cross-sectional view of a first embodiment of a connector seal device in an assembled position.

Referring to the drawings, FIG. 1 depicts an embodiment of a connector seal device 100. Embodiments of the connector seal device 100 may comprise a portion of a coaxial cable connector described herein. A coaxial cable connector embodiment may include the connector seal device 100 and can be provided to a user in a preassembled configuration to ease handling and installation during use. The connector seal device 100 may be configured for connection to an interface port as described below. A coaxial cable connector having connector seal device 100 may be an F-type connector, a feed-through type connector, or similar coaxial cable connector. Furthermore, the connector may include a post 40 (FIG. 5) configured for receiving a prepared portion of a coaxial cable 10 (FIG. 2).

Figure 1B:
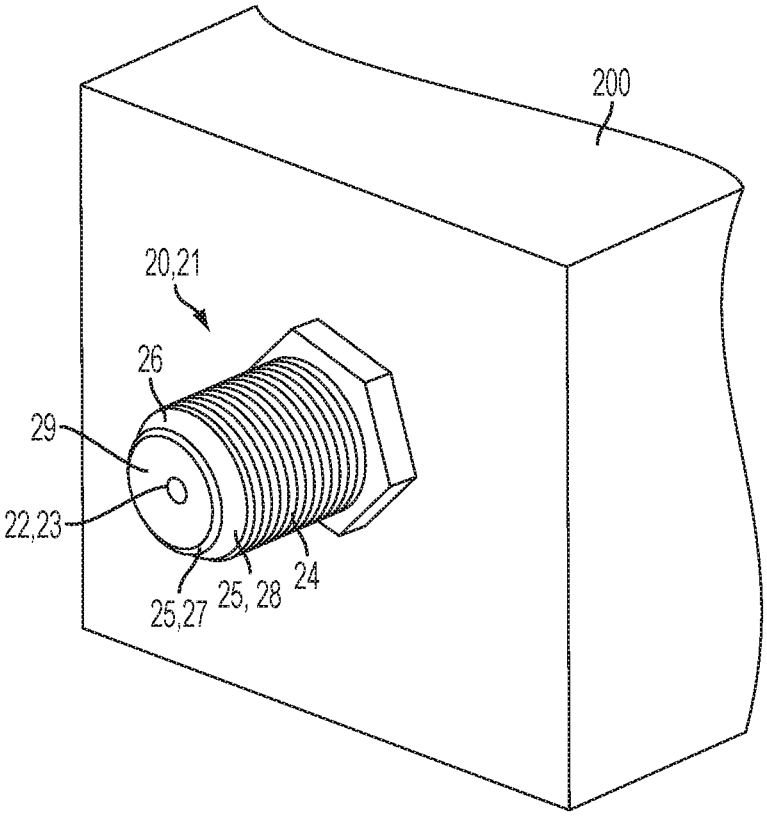
FIG. 1B is an isometric view of one embodiment of an interface port which is configured to be operatively coupled to a connector seal device.
Figure 2:
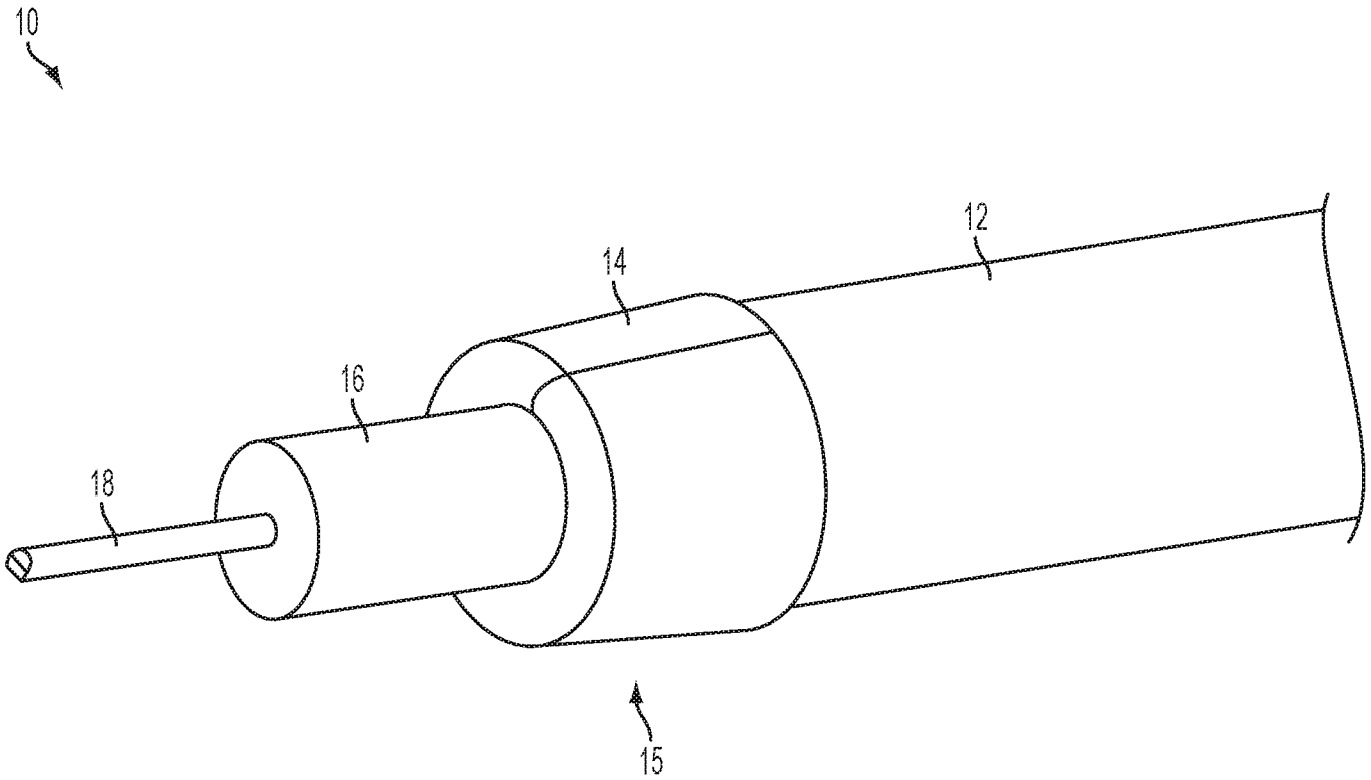
FIG. 2 depicts a perspective view of an embodiment of a coaxial cable.

With reference to FIG. 1B, the interface port 20 includes a stud or male jack, such as the stud 21. The stud 21 has: (a) an inner cylindrical wall 23 defining a conductive receptacle 22 configured to receive an electrical contact, wire or center conductor (not shown) positioned within the conductive receptacle 22; (b) a conductive, threaded outer surface 24; (c) a conical conductive region 25 having conductive contact sections 27 and 28; and (d) a dielectric or insulation material 29.

In one embodiment, stud 21 is shaped and sized to be compatible with the F-type coaxial connection standard. It should be understood that, depending upon the embodiment, stud 21 could have a smooth outer surface. The stud 21 can be operatively coupled to, or incorporated into, a device 200 which can include, for example, a cable splitter of a distribution box, outdoor cable junction box or service panel; a set-top unit; a TV; a wall plate; a modem; a router; or a junction device.

During installation, the installer couples a cable to an interface port 20 by screwing or pushing a connector seal device 100 of a cable connector onto the interface port 20. Once installed, the cable connector receives the interface port 20. The cable connector establishes an electrical connection between the coaxial cable and the electrical contact of the interface port 20.

After installation, the cable connectors often undergo various forces. For example, there may be tension in the cable as it stretches from one device 200 to another device 200, imposing a steady, tensile load on the cable connector. A user might occasionally move, pull or push on a cable from time to time, causing forces on the cable connector. Alternatively, a user might swivel or shift the position of a TV, causing bending loads on the cable connector. As described below, the cable connector is structured to maintain a suitable level of electrical connectivity despite such mechanical forces and other environmental influences.

Referring now to FIG. 2, a coaxial cable connector having connector seal device 100 may be operably affixed to a prepared, forward end 15 of a coaxial cable 10 so that the cable 10 is securely attached to the connector. The coaxial cable 10 may include a center conductor 18, surrounded by an interior dielectric 16; the interior dielectric 16 may be surrounded by a conductive foil layer; the interior dielectric 16 (and the possible conductive foil layer) is surrounded by a conductive strand layer 14; the conductive strand layer 14 is surrounded by a protective outer jacket 12, wherein the protective outer jacket 12 has dielectric properties and may serve as an insulator. The conductive strand layer 14 may extend an electrical grounding path, thereby providing an electromagnetic shield about the center conductor 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductor 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. The conductive strand layer 14 can be comprised of conductive materials suitable for carrying electric signals, providing an electrical ground connection or other electrical path. The conductive strand layer 14 may also be a conductive layer, braided layer, and the like. Various embodiments of the conductive strand layer 14 may be employed to screen unwanted noise. Those in the art will appreciate that various layer combinations may be implemented in order for the conductive strand layer 14 to effectuate an electromagnetic buffer helping to prevent ingress of environmental or other unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Referring back to FIG. 1A and FIG. 1B, a connector, including the connector seal device 100, may mate with a coaxial cable interface port 20. The coaxial cable interface port 20 includes a conductive receptacle 22 for receiving a portion of a coaxial cable center conductor 18 sufficient to make adequate electrical contact. Although the coaxial cable interface port 20 may comprise a threaded exterior surface 24, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a coaxial cable connector, such as the connectors described hereinbelow. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Figure 3A:
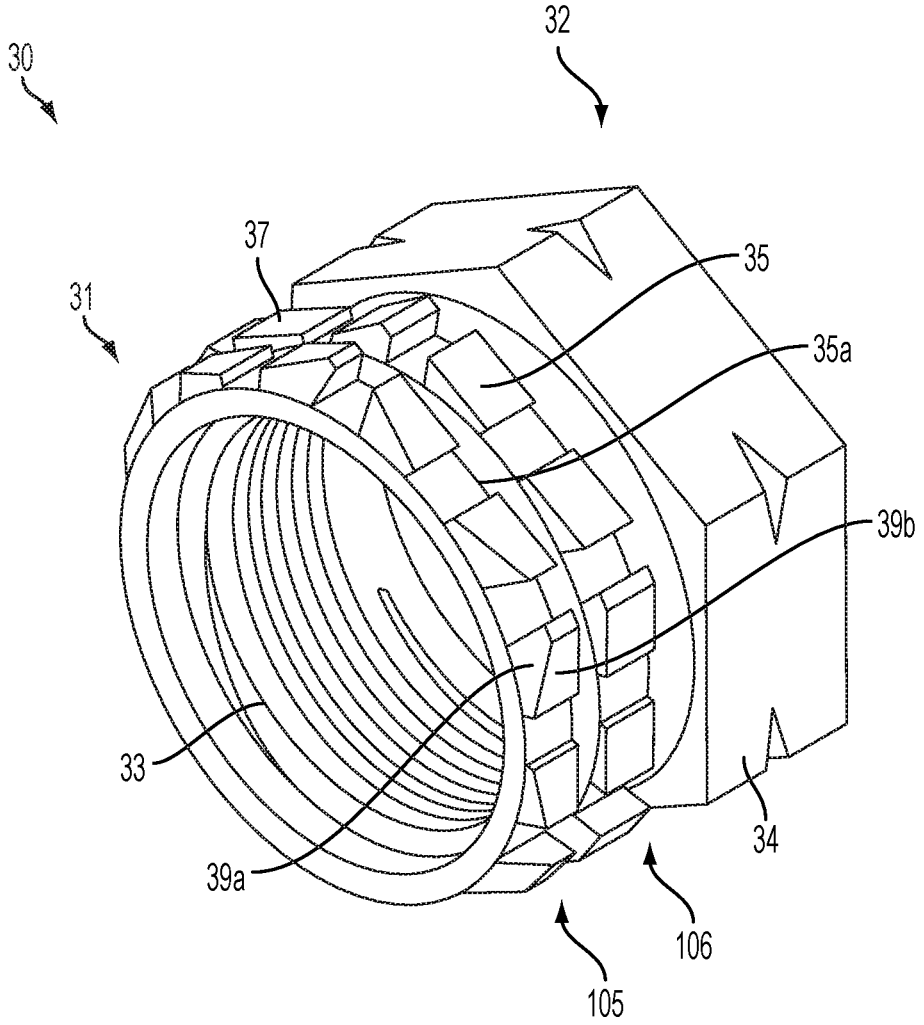
FIG. 3A depicts a perspective view of a first embodiment of a coupling member of the connector seal device.

Referring further to FIG. 1A, embodiments of the connector seal device 100 may include a seal member 70 and a coupling member 30, such as a nut. Referring still to FIG. 1A, and with additional reference to FIGS. 3A-3C, embodiments of the connector seal device 100 may include a port coupling member, or nut, 30. The coupling member 30 may be a threaded nut, port coupling element, rotatable port coupling element, and the like. The coupling member 30 may include a first (forward) end 31 facing in a forward direction 17, a second (rearward) end 32, facing in a rearward direction 19, an inner surface 33, an outer surface 34, and a generally axial opening therethrough. The inner surface 33 of the coupling member 30 may be a threaded configuration, the threads having a pitch and depth corresponding to a threaded port, such as interface port 20. In other embodiments, the inner surface 33 of the coupling element 30 may not include threads, and may be axially inserted over an interface port, such as interface port 20. The coupling element 30 may be rotatably secured to the post 40 to allow for rotational movement about the post 40. The coupling member 30 may comprise an internal lip 36 located proximate the second (rearward) end 32 and configured to hinder or prevent axial movement, or displacement, relative to the post 40. Furthermore, the coupling member 30 may comprise a cavity 39 extending axially from the edge of second (rearward) end 32 and partially defined and bounded by the internal lip 36. The cavity 39 may also be partially defined and bounded by an interior surface of an outer wall.

Furthermore, embodiments of the coupling member 30 may include a retention portion 37 configured to mechanically bond with, interlock with, frictionally fit with and/or retain the seal member 70. Embodiments of the retention portion 37 of the coupling member 30 may include an irregularity, such as teeth 35. Embodiments of the teeth 35 may be one or more protruding structures extending or jutting outward from the outer surface 34 of the retention portion 37 of the coupling member 30. For example, embodiments of the teeth 35 may extend radially outward from the outer surface 34 of the retention portion 37 of the coupling member 30. The protruding gripping structures, such as teeth 35, may include gaps between them, wherein the gaps may receive portions of the seal member 70 when the seal member 70 is formed over the retention portion 37. Therefore, the engagement between the teeth 35 and the seal member 70 may resist, prevent, or at least hinder axial and radial movement or detachment of the seal member 70 from the retention portion 37 of the coupling member 30. Moreover, the teeth 35 may be integral with the general body of the coupling member 30, or may be separately fastened or adhered to the outer surface 34 of the coupling member 30. Embodiments of the teeth 35 may be the same or similar to each other, or have a different structure. The structure of the teeth 35 may include at least one radial face 39*a* and an axial face 39*b*; embodiments of the teeth 35 may include four or more radial faces 39*a*, and two or more axial faces 39*b*. Embodiments of the radial face 39*a* may face toward the first (forward) end 31 or the second (rearward) end 32 of the coupling member 30, or may face a non-axial direction with respect to a general central axis 5 of the connector seal device 100. The radial faces 39*a* may define a height of the tooth in a radial direction from the outer surface 34 of the coupling member 30. Embodiments of the axial face 39*b* may face away from the outer surface 34 of the coupling member 30, and may be inclined with respect to the outer surface 34 of the coupling member 30. For instance, the axial face(s) 39*b* of the teeth 35 may be oriented at various angles with respect to the outer surface 34 of the coupling member 30 to enhance a retention or bond with the seal member 70. In other words, embodiments of the teeth 35 may all be oriented at a same angle, or each tooth may be oriented at different angles. In further embodiments, the teeth 35 may include teeth 35 angled at the same angles and different angles.

Figure 3B:
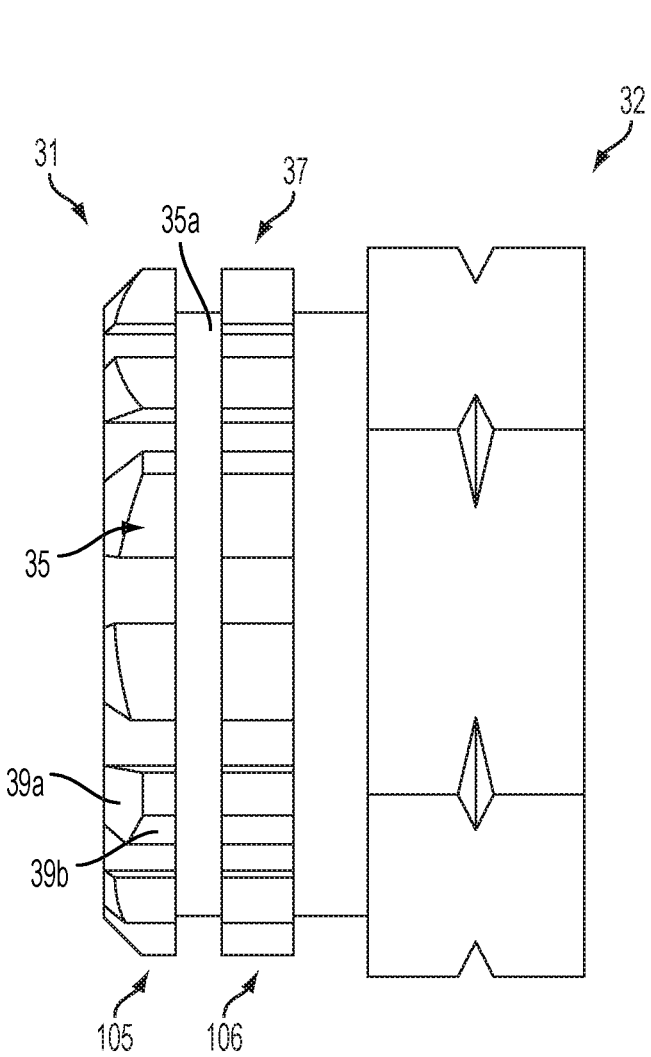
FIG. 3B depicts a side view of the first embodiment of the coupling member.
Figure 3C:
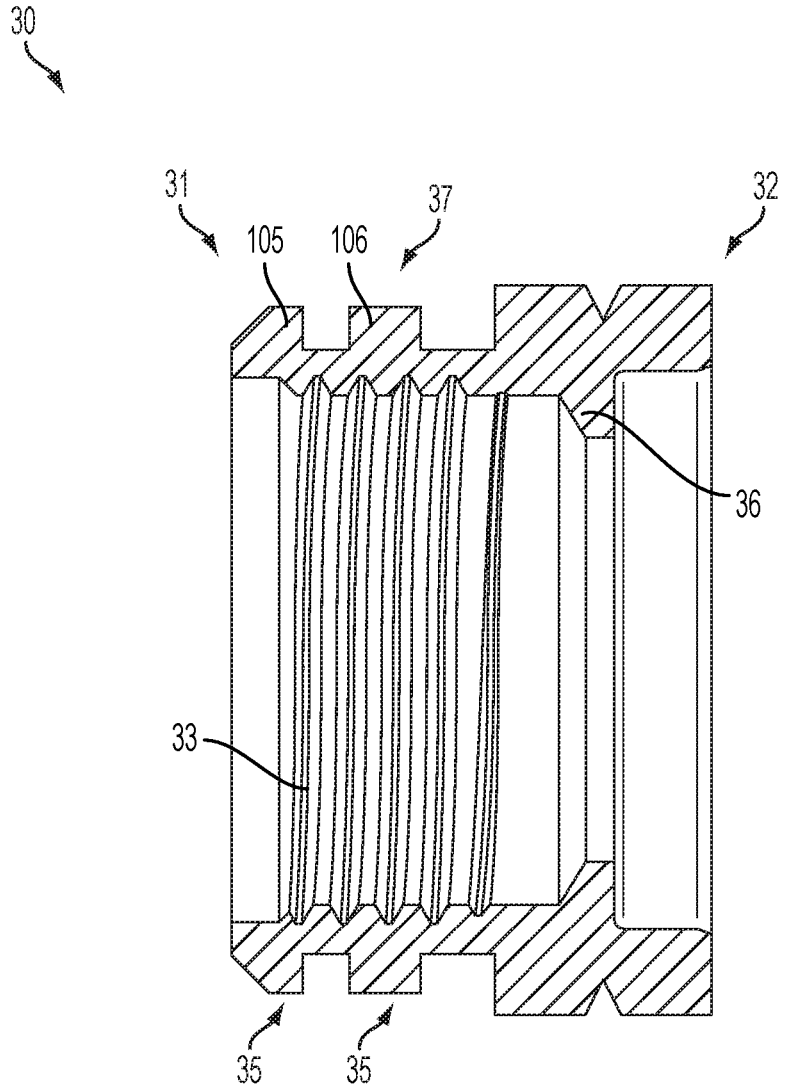
FIG. 3C depicts a cross-sectional view of the first embodiment of the coupling member.

Referring to FIG. 3B, embodiments of the retention portion 37 of the coupling member 30 may include one or more rows of such surface irregularities 105, 106 such as the protrusions or teeth 35. For instance, a first row of teeth 105 and a second row of teeth 106 may be positioned circumferentially around the retention portion 37 of the coupling member 30. The first row and the second row of teeth 105, 106 may define a groove 35*a* therebetween. Embodiments of the groove 35*a* may be an annular or semi-annular groove, a channel, an opening, a void, or space between rows of teeth, such as the first row and second row of teeth 105, 106. Embodiments of groove 35*a* may receive portions of the seal member 70 that forms over and fill in between the teeth 35, in addition to any gaps surrounding the teeth 35 outside the groove(s) 35*a*. Embodiments of the coupling member 30 may include more than one groove 35*a* to accommodate more than two rows of teeth 35. In alternative embodiments, the coupling member 30 may include teeth 35 positioned in various patterns or randomly on the retention portion 37 of the coupling member 30 (e.g. no ordered rows).

Figure 4:
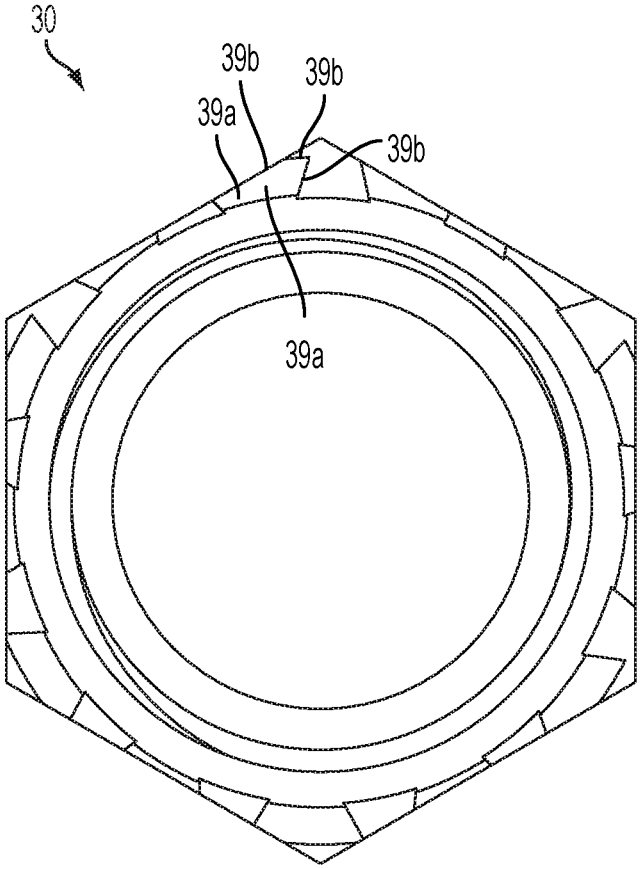
FIG. 4 depicts a front view of the first embodiment of the coupling member.

With continued reference to FIGS. 1A-1B, 3A-3C, and additional reference to FIG. 4, embodiments of the teeth 35 of the retention portion 37 of the coupling member 30 may comprise surfaces that are generally aligned according to a hex-shaped outline to resist or prevent rotatable movement of the seal member 70 when the seal member 70 is formed over the retention portion 37. For instance, the axial face(s) 39*b* of the teeth 35 may be oriented so as to be coplanar with a plurality of sides of the coupling member 30. In one embodiment, the axial faces 39*b* of the teeth 35 may form six sides, as seen in FIG. 4, wherein the axial faces 39*b* forming each side are coplanar. Accordingly, due to this orientation, the radial faces 39*a* of the teeth 35 may effectively resist torque exerted onto the seal member 70 if a user twists or rotates the seal member 70. Moreover, the coupling member 30 may be formed of conductive materials facilitating grounding through the coupling member, or threaded nut, 30. Accordingly, the coupling member 30 may be configured to extend an electromagnetic buffer by electrically contacting conductive surfaces of an interface port 20 when a coaxial cable connector is advanced onto the interface port 20. In addition, the coupling member 30 may be formed of non-conductive material and function only to mechanically engage and physically secure and advance a connector onto an interface port 20.

In addition, the coupling element 30 may be formed of metals, polymers or other materials or a combination thereof that would facilitate a rigidly formed body. Manufacture of the coupling member 30 may include casting, extruding, cutting, turning, tapping, drilling, injection molding, blow molding, or other fabrication methods that may provide efficient production of the component. In an embodiment, the coupling member 30 may be manufactured from hex bar stock, as opposed to being manufactured from round bar stock, wherein the hex shape has to be machined into the coupling member; the teeth 35 may be machined or otherwise formed or attached onto the coupling member 30. The hexagonal shape of the coupling member 30 facilitates rotation of the coupling member 30 using a tool such as a wrench or pliers.

Referring back to FIG. 1A, embodiments of the connector seal device 100 may include a seal member 70. Embodiments of the seal member 70 may include a first (forward) end 71, a second (rearward) end 72, an inner surface 73, an outer surface 74, and a generally axial opening therethrough. Embodiments of seal member 70 may have a generally tubular body that is elastically deformable by nature of its material characteristics and design. In most embodiments, the seal member 70 is a unitary or one-piece element made of a compression molded, elastomeric material having suitable chemical resistance and material stability (i.e., elasticity) over a temperature range between about −40° C. to about +40° C. For example, the seal member 70 may be made of silicone rubber. Alternatively, the material may be propylene, a typical O-ring material. Other materials known in the art may also be suitable. Furthermore, the first (forward) end 71 of seal member 70 may be a free end for ultimate engagement with an interface port 20, or other male connector, while the second (rearward) end 72 may be for mechanical bonding or interlocking with the coupling member 30. The seal 70 is a unitary structure and may have a forward sealing portion 76*a*, and an integral joint-section 76*c* intermediate the first (forward) end 71 and the second (rearward) end 72 of the tubular body of the seal member 70.

Embodiments of the forward sealing portion 76*a* may be configured to engage threads, or outer surface, of an interface port 20. The forward sealing portion 76*a* proximate the first (forward) end 71 of the seal member 70 may also include annular facets to assist in forming a seal with a port, such as interface port 20. Alternatively, forward sealing portion 76*a* may be a continuous rounded annular surface that forms effective seals through the elastic deformation of the inner surface 73 and forward end of the seal member 70 compressed against the interface port 20. Embodiments of the integral joint-section 76*c* may include a portion of the length of the seal member 70 which can have a tapered radial cross-section to encourage an outward expansion or bowing of the seal 70 upon its axial compression. Accordingly, compressive axial force may be applied against one or both ends of the seal depending upon the length of the port intended to be sealed. The force can act to axially compress the seal whereupon it can expand radially in the vicinity of the integral joint-section 76*c*. It is contemplated that the joint-section 76*c* can be designed to be inserted anywhere between the sealing surface and the first (forward) end 71. The seal member 70 may prevent the ingress of water, moisture, contaminants, debris, and corrosive elements when the seal is used for its intended function. Moreover, embodiments of the seal member 70 may include a bonding portion 76*b* configured for molded engagement with the retention portion 37 of the coupling member 30.

With continued reference to FIG. 1A, the manner in which embodiments of connector seal device 100 are assembled will now be described. Embodiments of the seal member 70 may be injected or otherwise formed or molded over the retention portion 37 of the coupling member 30 to mechanically bond or integrate the seal member 70 and the coupling member 30. For example, the bonding portion 76*b* of the seal member 70 may be molded onto the retention portion 37 of the coupling member 30, wherein portions of the seal member 70 seep into gaps surrounding the teeth 35 and into the groove(s) 35*a* between the rows of irregularities 105, 106, such as protrusions or teeth, such that the seal member 70 mechanically bonds or interlocks with the coupling member 30. In another embodiment, the seal member 70 may be integrated or assembled with the coupling member 30 through a process called insert molding, wherein the coupling member 30 is inserted into a mold, and the seal material may be cast or molded over the surface of the coupling member so that the components 30, 70 of the connector seal device 100 come out as one piece. It should be noted that such a process for forming an integral connector seal device 100 does not require that the outer surface 34 of retention portion 37 comprise irregularities 105, 106 or protrusions. In one embodiment (e.g. FIG. 24), the outer surface 34 of the retention portion 37 of the coupling member 30 may be smooth. The operable integration or attachment of the seal member 70 to the coupling member 30 may provide an integral environmental seal for a connector having connector seal device 100. The mechanical bond or press fit between the seal member 70 and the teeth 35 of the coupling member 30 may at least withstand a rotational force of a user hand tightening the connector seal device 100 onto the interface port 20. Moreover, the mechanical bond or press fit between the teeth 35 and bonding portion 76*b* of the seal member 70 may retain the seal member 70 onto the coupling member 30 by resisting, preventing, or otherwise hindering axial and angular movement of the seal member 70 with respect to the coupling member 30.

Figure 5:
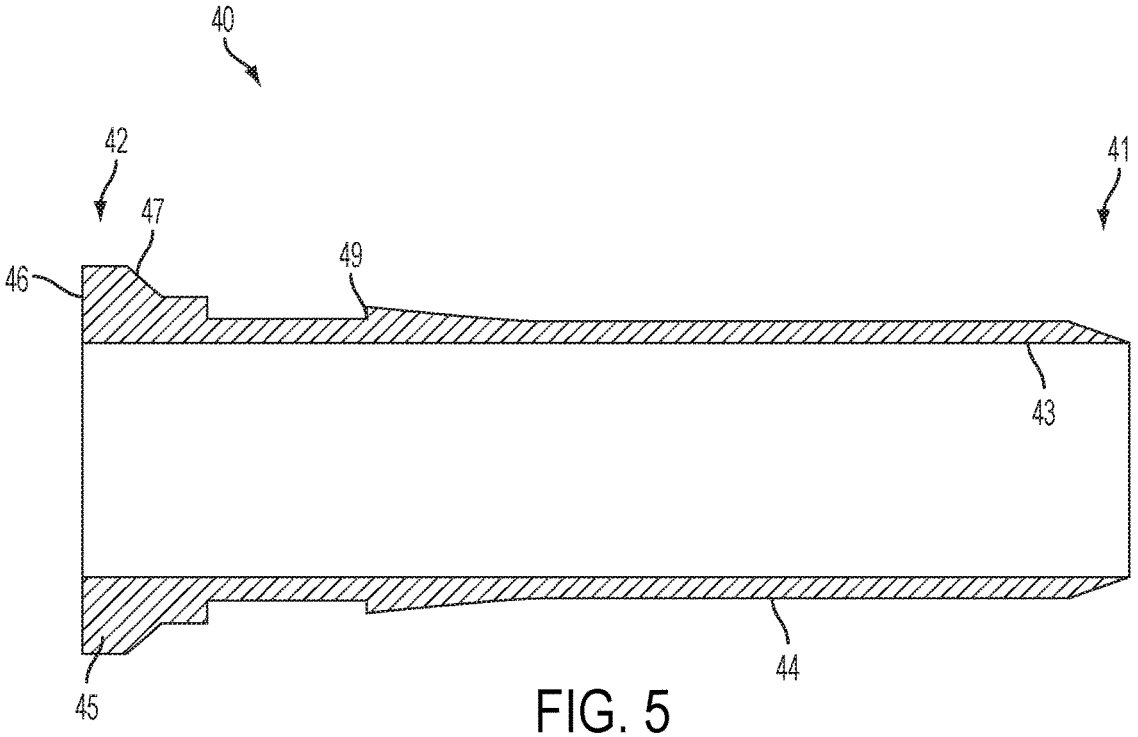
FIG. 5 depicts a cross-sectional view of an embodiment of a connector component, such as a post.
Figure 6:
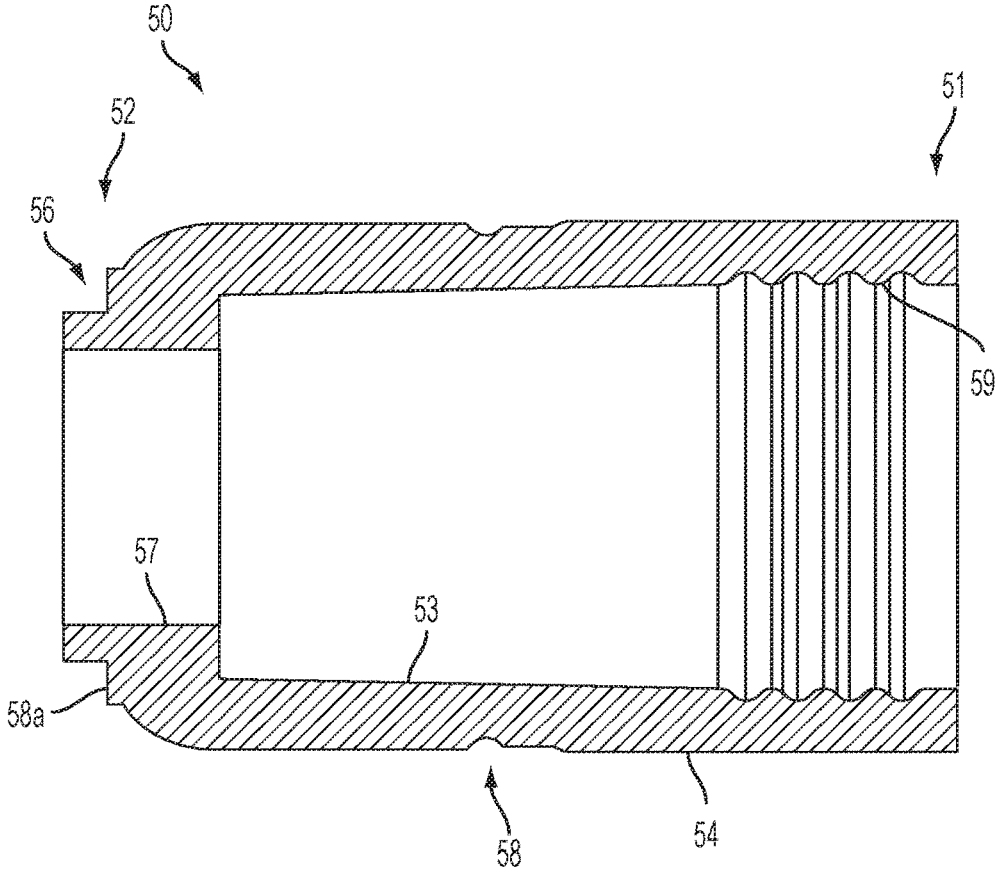
FIG. 6 depicts a cross-sectional view of an embodiment of a connector component, such as a connector body.
Figure 7:
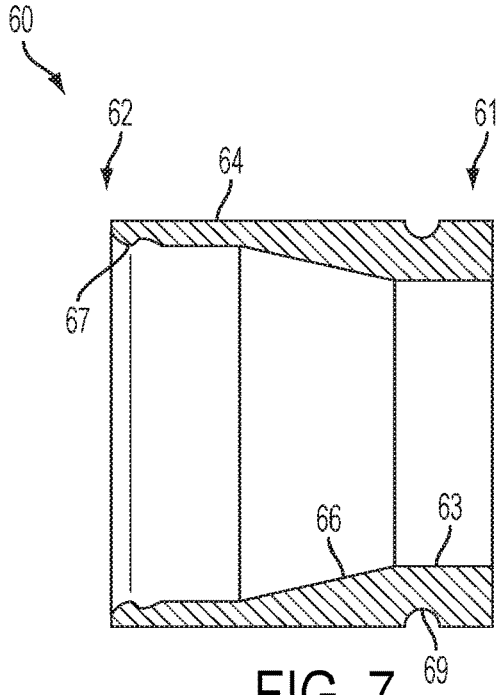
FIG. 7 depicts a cross-sectional view of an embodiment of a connector component, such as a fastener member.
Figure 8:
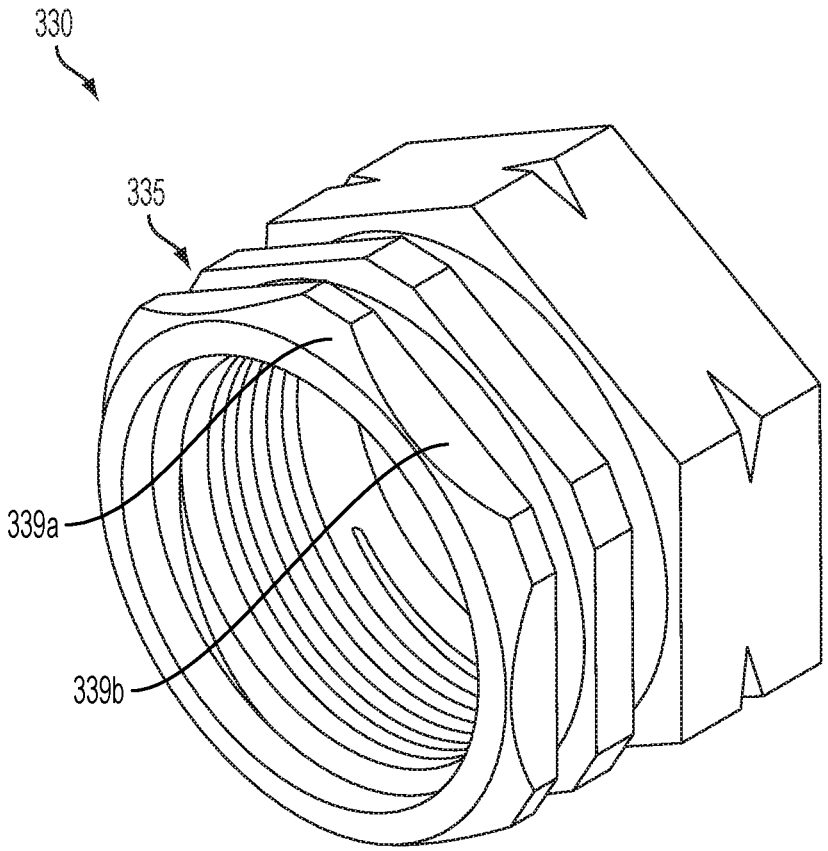
FIG. 8 depicts a perspective view of a second embodiment of a coupling member of the connector seal device.
Figure 9:
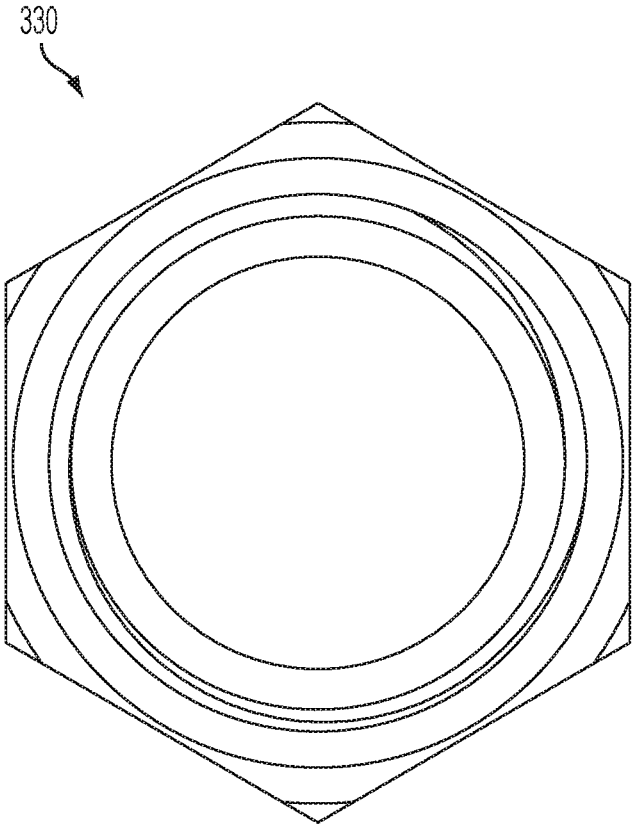
FIG. 9 depicts a front view of the second embodiment of the coupling member.
Figure 10:
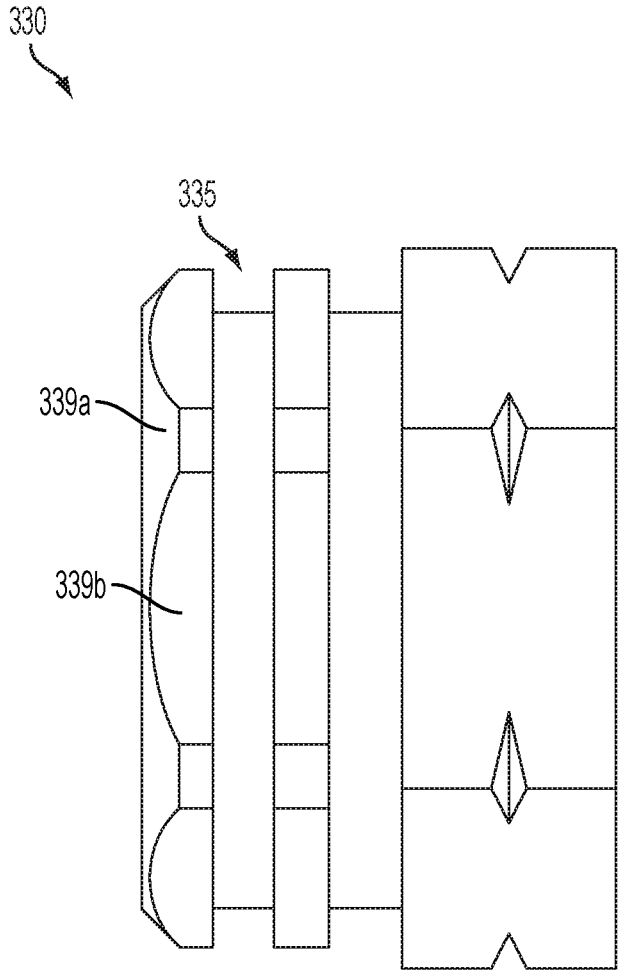
FIG. 10 depicts a side view of the second embodiment of the coupling member.
Figure 11:
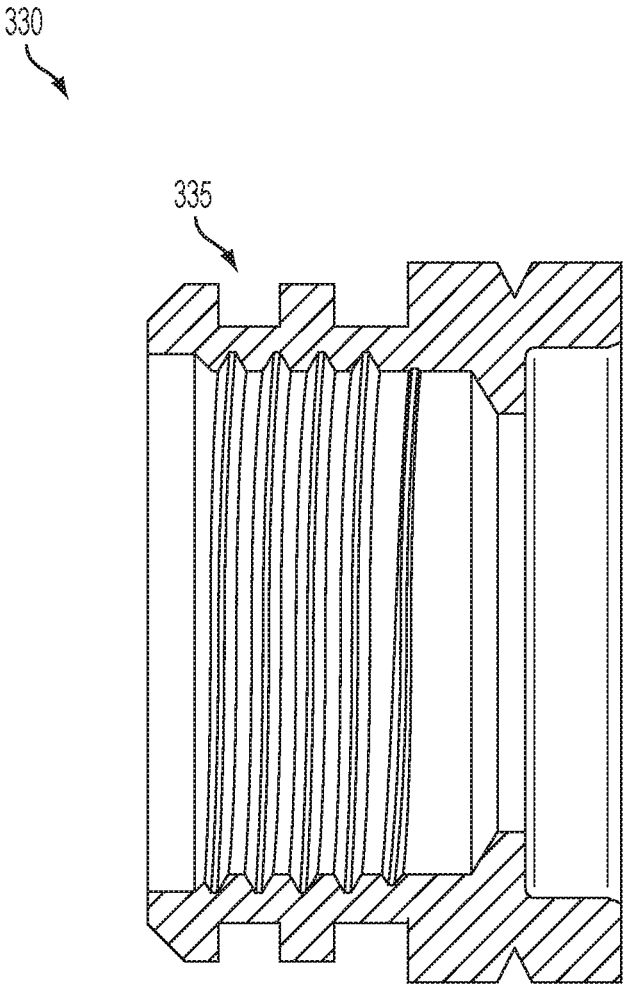
FIG. 11 depicts a cross-sectional view of the second embodiment of the coupling member.
Figure 12:
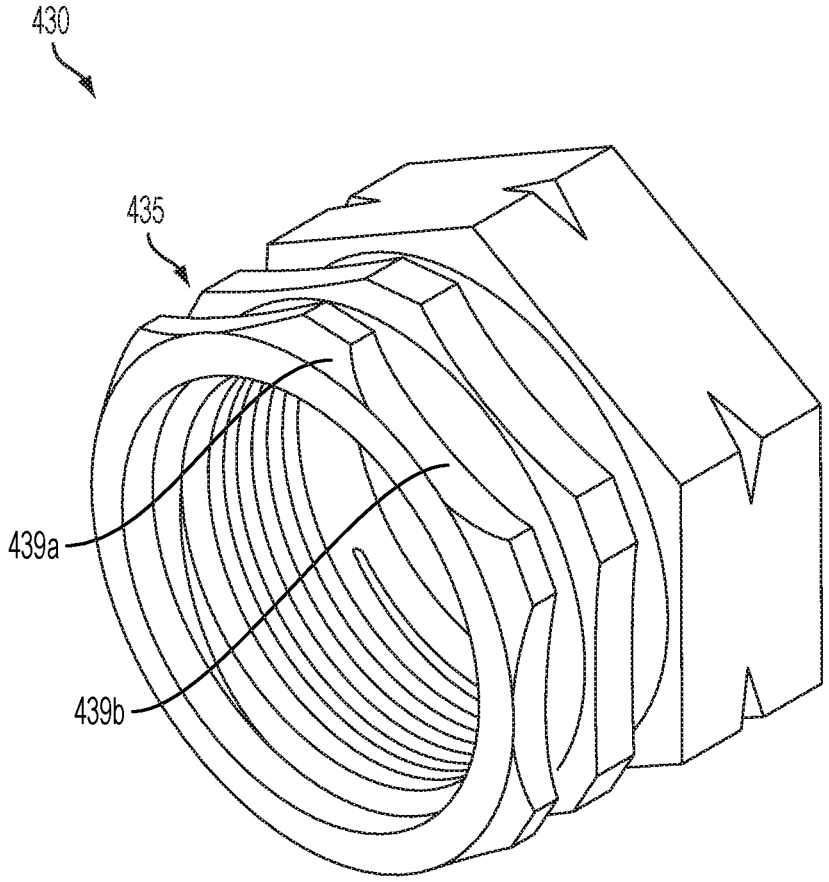
FIG. 12 depicts a perspective view of a third embodiment of a coupling member of the connector seal device.
Figure 13:
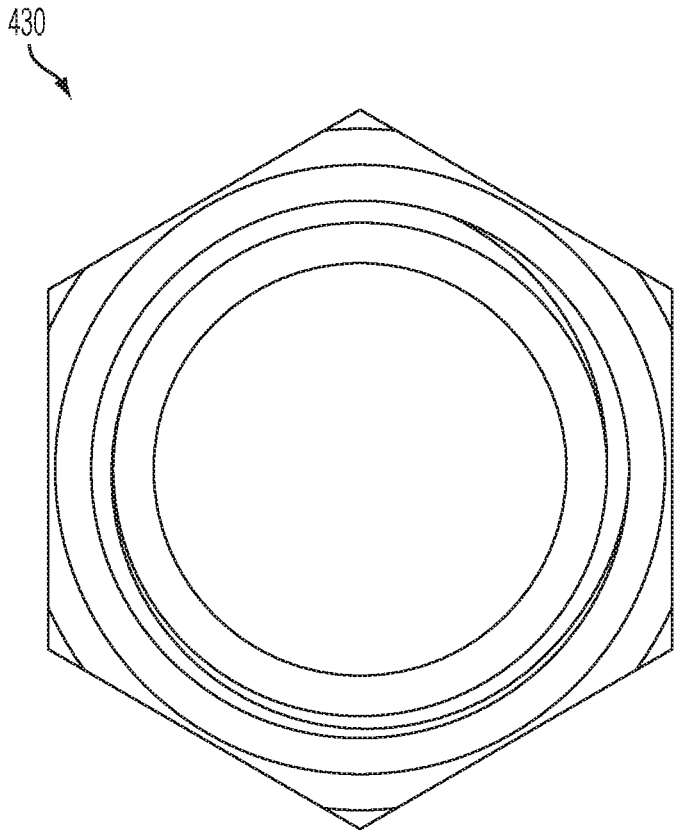
FIG. 13 depicts a front view of the third embodiment of the coupling member.
Figure 14:
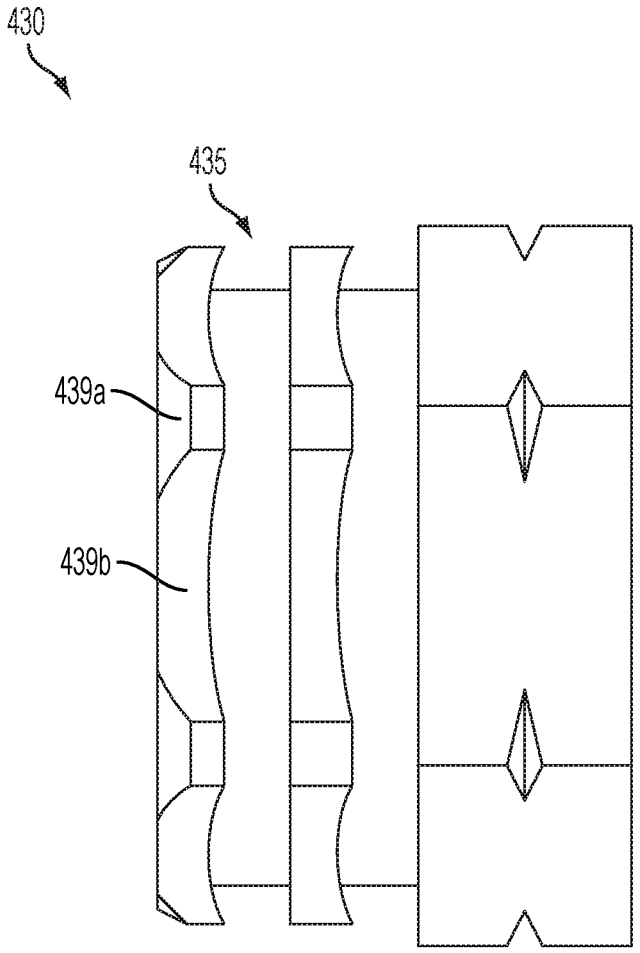
FIG. 14 depicts a side view of the third embodiment of the coupling member.
Figure 15:
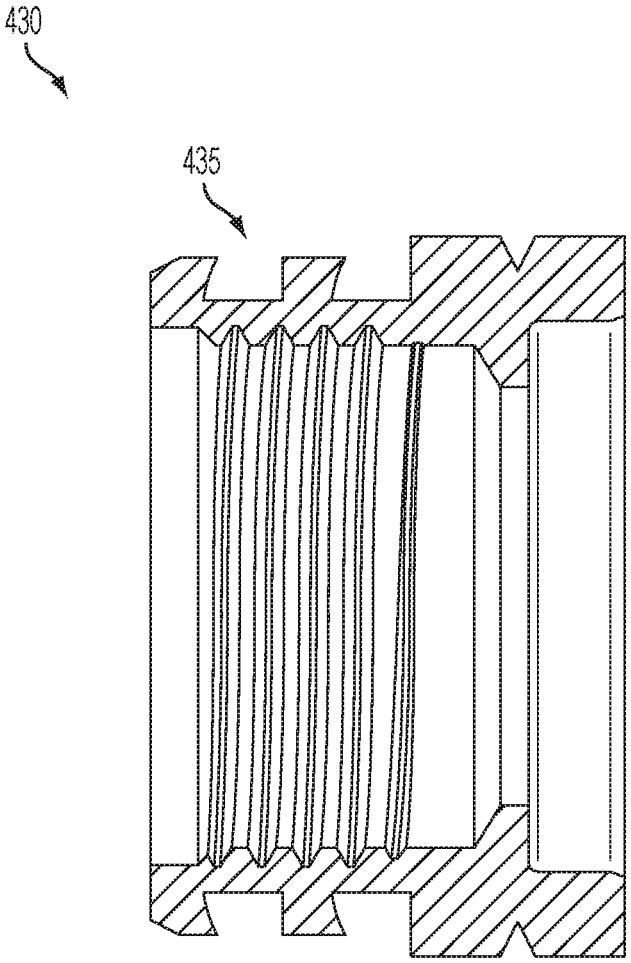
FIG. 15 depicts a cross-sectional view of the third embodiment of the coupling member.
Figure 16:
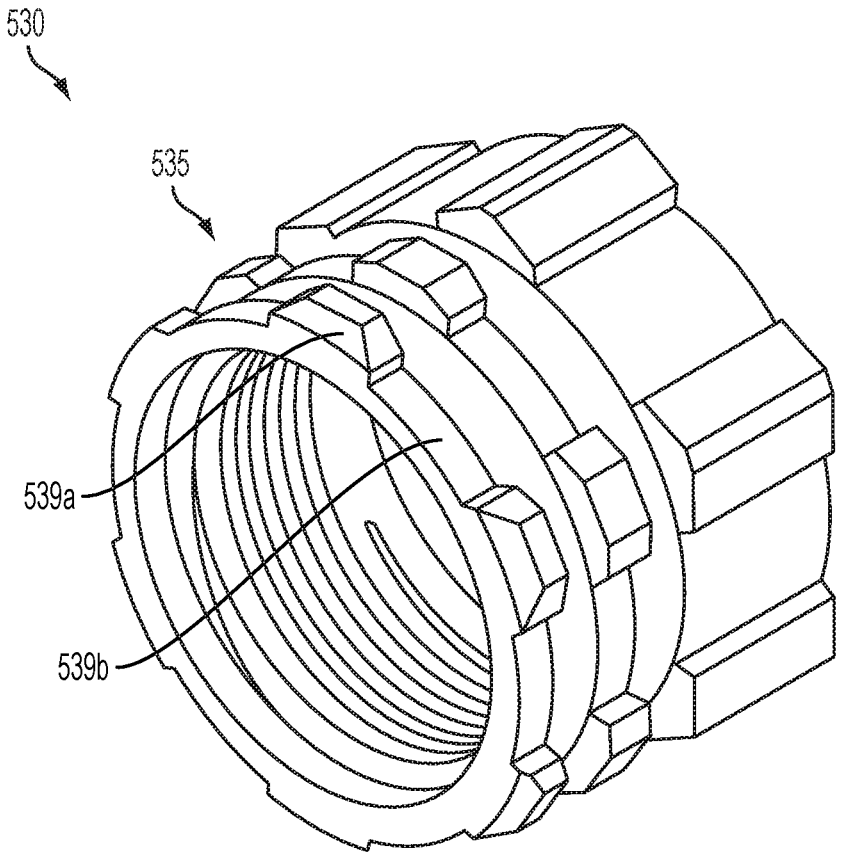
FIG. 16 depicts a perspective view of a fourth embodiment of a coupling member of the connector seal device.
Figure 17:
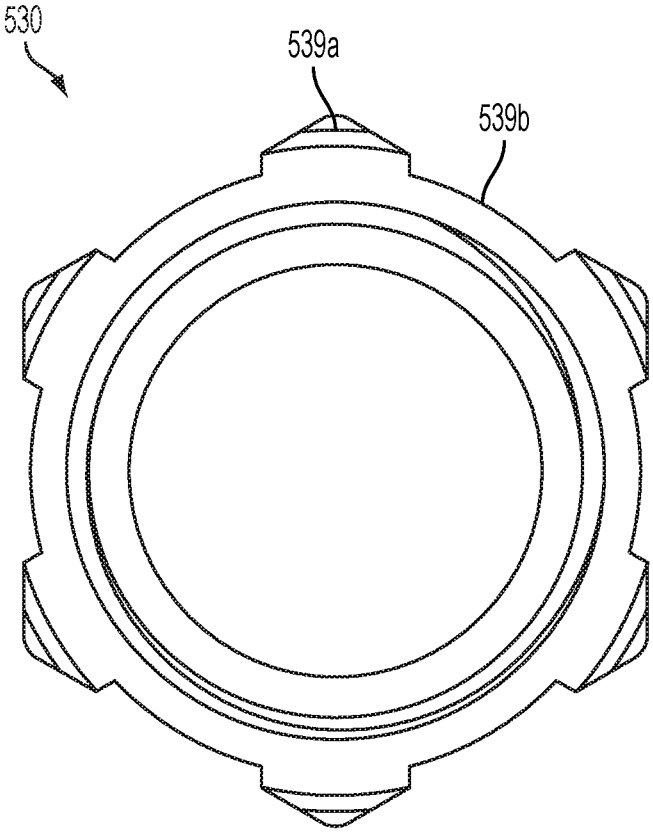
FIG. 17 depicts a front view of the fourth embodiment of the coupling member.
Figure 18:
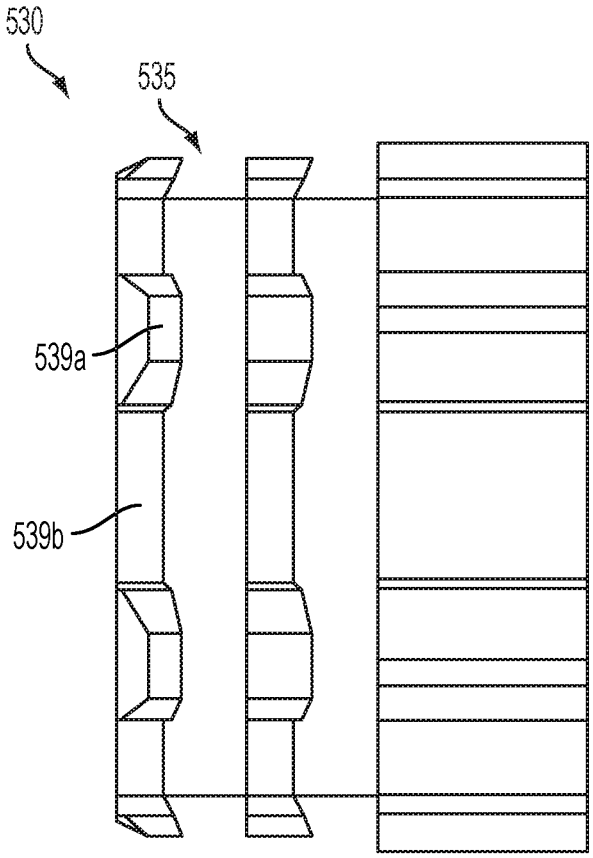
FIG. 18 depicts a side view of the fourth embodiment of the coupling member.
Figure 19:
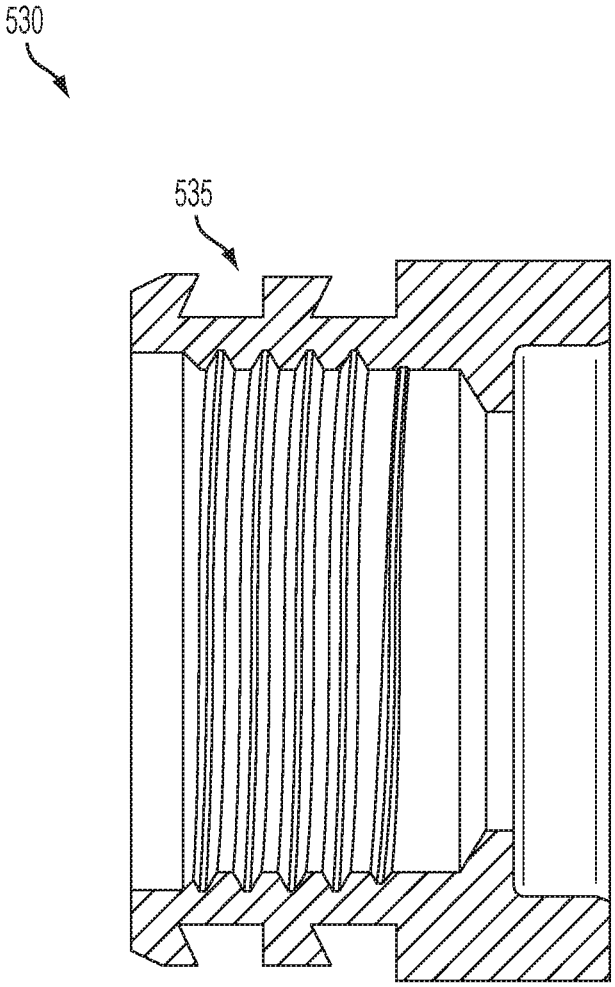
FIG. 19 depicts a cross-sectional view of the fourth embodiment of the coupling member.

With continued reference to the drawings, FIGS. 5-7 depict embodiments of components of a coaxial cable connector. Embodiments of a cable connector (e.g. FIGS. 21-23) having a connector seal device 100 may also include a post 40, a connector body 50, and a fastener member 60.

Embodiments of the connector may include a post 40. The post 40 comprises a first (rearward) end 41, a second (forward) end 42, an inner surface 43, and an outer surface 44. Furthermore, the post 40 may include a flange 45, such as an externally extending annular protrusion, located proximate or otherwise at the second end 42 of the post 40. The flange 45 may include an outer tapered surface 47 facing generally toward the first end 41 of the post 40 (i.e. tapers inward toward the first end 41 from a larger outer diameter proximate or otherwise at the second (forward) end 42 to a smaller outer diameter). The outer tapered surface 47 of the flange 45 may correspond, for mechanical engagement, to a tapered surface of the lip 36 of the coupling member 30. Further still, an embodiment of the post 40 may include a surface feature 49 such as a lip or protrusion that may engage a portion of a connector body 50 to axially secure the post 40 relative to the connector body 50. However, the post may not include such a surface feature 49, and the coaxial cable connector may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, knurling, or other irregularities which may enhance securing the post 40 onto the connector body 50.

Additionally, the post 40 includes a mating edge 46, which may be configured to make physical and/or electrical contact with a corresponding mating edge 26 of an interface port 20. The post 40 should be formed such that portions of a prepared coaxial cable 10 including the dielectric 16 and center conductor 18 can pass axially into the first (rearward) end 41 and/or through a portion of the tube-like body of the post 40. Moreover, the post 40 can be dimensioned such that the post 40 may be inserted into a forward end of the prepared coaxial cable 10, around the dielectric 16 and under the protective outer jacket 12 and conductive grounding shield or strand 14. Accordingly, where an embodiment of the post 40 may be inserted into a forward end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer or other non-conductive material. Manufacture of the post 40 may include casting, extruding, cutting, turning, drilling, knurling, injection molding, spraying, blow molding, component overmolding, or other fabrication methods that may provide efficient production of the component.

Referring to FIG. 6, embodiments of a coaxial cable connector may include a connector body 50. The connector body 50 may include a first (rearward) end 51, a second (forward) end 52, an inner surface 53, and an outer surface 54. Moreover, the connector body 50 may include a post mounting portion 57 proximate or otherwise near or at the second (forward) end 52 of the body 50; the post mounting portion 57 is configured to securely locate the body 50 relative to a portion of the outer surface 44 of post 40, so that the connector body 50 is axially secured with respect to the post 40, in a manner that can prevent the two components from moving with respect to each other in a direction parallel to the longitudinal axis of the connector. In addition, the connector body 50 may include a shoulder 58*a* defining an outer annular recess 56 located proximate, at or near the second (forward) end 52 of the connector body 50. Furthermore, the connector body 50 may include a semi-rigid, yet compliant outer surface 54, wherein the outer surface 54 may be configured to form an annular seal when the first (rearward) end 51 is deformably compressed against a received coaxial cable 10 by operation of a fastener member 60. The connector body 50 may include an external annular detent 58 located along the outer surface 54 of the connector body 50. Further still, the connector body 50 may include internal surface features 59, such as annular serrations formed on the internal surface of the connector body 50 near or proximate the first (rearward) end 51 of the connector body 50, which are configured to enhance frictional restraint and gripping of an inserted and received coaxial cable 10, through tooth-like frictional interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With reference now to FIG. 7, embodiments of a coaxial cable connector having connector seal device 100 may also include a fastener member, or compression ring, 60. The fastener member 60 may have a first (rearward) end 61, second (forward) end 62, inner surface 63, and outer surface 64. In addition, the fastener member 60 may include an internal annular protrusion 67 located proximate the second (forward) end 62 of the fastener member 60 and configured to mate and achieve purchase with the annular detent 58 on the outer surface 54 of connector body 50. Moreover, the fastener member 60 may comprise a central passageway or generally axial opening defined between the first (rearward) end 61 and second (forward) end 62 and extending axially through the fastener member 60. The central passageway may include a ramped surface 66 which may be positioned between a first opening or inner bore having a first inner diameter positioned proximate or otherwise near the first (rearward) end 61 of the fastener member 60 and a second opening or inner bore having a larger, second inner diameter positioned proximate or otherwise near the second (forward) end 62 of the fastener member 60. The ramped surface 66 may act to deformably compress the outer surface 54 of the connector body 50 when the fastener member 60 is operated to secure a coaxial cable 10. For example, the narrowing geometry will compress or squeeze the first (rearward) end 51 of the connector body 50 against the cable 10, when the fastener member 60 is compressed into a tight and secured position on the connector body 50.

Additionally, the fastener member 60 may comprise an exterior surface feature 69, such as an annular groove, positioned proximate with or close to the first (rearward) end 61 of the fastener member 60. The surface feature 69 may facilitate gripping of the fastener member 60 during manipulation or operation of the connector seal device 100. Although the surface feature 69 is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

A connector having a connector seal device 100 may incorporate a different component or technique to form a seal against the cable 10. For instance, the connector may include a fastener member 60 that is disposed within the rearward opening of the connector body 50 to form a seal against the cable 10 (as illustrated in the embodiments of FIGS. 22-23). Moreover, the connector may include a connector body 50 having a frangible portion configured to break apart from the connector body 50 and compress against the cable 10. Other embodiments of the connector may simply have a crimped region to form a seal against the cable.

FIGS. 8-11 depict an embodiment of a coupling member 330 which may be coupled to seal member 70, as illustrated in FIG. 1, such as by replacing the coupling member 30 (FIG. 1) with the coupling member embodiment 330. Embodiments of coupling member 330 may share the same structural and functional aspects as coupling member 30 as described herein with reference to FIGS. 1 and 3A-3C, such as being configured for operable environmental sealing engagement to seal member 70. In one embodiment, coupling member 330 may include surface irregularities 335, such as teeth that may have a different orientation than teeth 35 described in association with coupling member 30. For instance, teeth 335 may include a plurality of peaks 339*a* and a plurality of valleys 339*b*, wherein the valleys 339*b* may be positioned between the peaks 339*a* positioned circumferentially around the coupling member 330. Furthermore, embodiments of the plurality of peaks 339*a* and the plurality of valleys 339*b* of the coupling member 330 may include one or more rows of peaks 339*a* and valleys 339*b*, defining a groove therebetween and positioned circumferentially around the retention portion of the coupling member 330. Embodiments of the groove may be an annular or semi-annular groove, a channel, an opening, a void, or space between rows of peaks 339*a* and valleys 339*b*, such as described herein with respect to groove 35*a* of FIG. 3B. Embodiments of the groove may receive portions of the seal member 70 that form over and fill in between the peaks 339*a* and valleys 339*b*, in addition to any gaps therebetween. Embodiments of the coupling member 330 may include more than one groove to accommodate more than two rows of peaks 339*a* and valleys 339*b*. In alternative embodiments, the coupling member 330 may include peaks 339*a* and valleys 339*b* positioned randomly on the retention portion of the coupling member 330 (e.g. no ordered rows).

FIGS. 12-15 depict an embodiment of a coupling member 430 which may be coupled to seal member 70, as illustrated in FIG. 1, such as by replacing the coupling member 30 (FIG. 1) with the coupling member embodiment 430. Embodiments of coupling member 430 may share the same structural and functional aspects as coupling member 30 as described herein with reference to FIGS. 1 and 3A-3C, such as being configured for operable environmental sealing engagement to seal member 70. In one embodiment, coupling member 430 may include surface irregularities such as teeth 435 that may have a different orientation than teeth 35 described in association with coupling member 30. For instance, teeth 435 may include a plurality of peaks 439*a* and a plurality of valleys 439*b*, wherein the valleys 439*b* may be positioned between the peaks 439*a* positioned circumferentially around the coupling member 430. Moreover, embodiments of the valleys 439*b* may have a higher incline angle with respect to the peaks 439*a*, as compared to coupling member 330. Furthermore, embodiments of the plurality of peaks 439*a* and the plurality of valleys 439*b* of the coupling member 430 may include one or more rows of peaks 439*a* and valleys 439*b*, defining a groove therebetween and positioned circumferentially around the retention portion of the coupling member 430. Embodiments of the groove may be an annular or semi-annular groove, a channel, an opening, a void, or space between rows of peaks 439*a* and valleys 439*b*, such as described herein with respect to groove 35*a* of FIG. 3B. Embodiments of the groove may receive portions of the seal member 70 that form over and fill in between the peaks 439*a* and valleys 439*b*, in addition to any gaps therebetween. Embodiments of the coupling member 430 may include more than one groove to accommodate more than two rows of peaks 439*a* and valleys 439*b*. In alternative embodiments, the coupling member 430 may include peaks 439*a* and valleys 439*b* positioned randomly on the retention portion of the coupling member 430 (e.g. no ordered rows).

FIGS. 16-19 depict an embodiment of a coupling member 530 which may be coupled to seal member 70, as illustrated in FIG. 1, such as by replacing the coupling member 30 (FIG. 1) with the coupling member embodiment 530. Embodiments of coupling member 530 may share the same structural and functional aspects as coupling member 30 as described herein with reference to FIGS. 1 and 3A-3C, such as being configured for operable environmental sealing engagement to seal member 70. In one embodiment, coupling member 530 may include teeth 535 that may have a different orientation than teeth 35 described in association with coupling member 30. For instance, teeth 535 may comprise a plurality of protrusions 539*a* positioned circumferentially around the coupling member 530, wherein a smooth, flat surface 539*b* may be positioned between the plurality of protrusions 539*a*. Furthermore, embodiments of the plurality of protrusions 539*a* and the plurality of flat surfaces 539*b* of the coupling member 530 may include one or more rows of protrusions 539*a* and of flat surfaces 539*b*, defining a groove therebetween and positioned circumferentially around the retention portion of the coupling member 530. Embodiments of the groove may be an annular or semi-annular groove, a channel, an opening, a void, or space between rows of protrusions 539*a* and of flat surfaces 539*b*, such as described herein with respect to groove 35*a* of FIG. 3B. Embodiments of the groove may receive portions of the seal member 70 that form over and fill in between the protrusions 539*a* and the flat surfaces 539*b*, in addition to any gaps therebetween. Embodiments of the coupling member 530 may include more than one groove to accommodate more than two rows of protrusions 539*a* and of flat surfaces 539*b*. In alternative embodiments, the coupling member 530 may include protrusions 539*a* and flat surfaces 539*b* positioned randomly on the retention portion of the coupling member 530 (e.g. no ordered rows).

Referring to FIGS. 1-19, a method of providing a seal member onto a coaxial cable connector may include the steps of providing a seal member 70 and a coupling member 30, 330, 430, 530 and forming the seal member 70 over the coupling member 30, 330, 430, 530 to integrate the seal member 70 therewith.

Figure 20A:
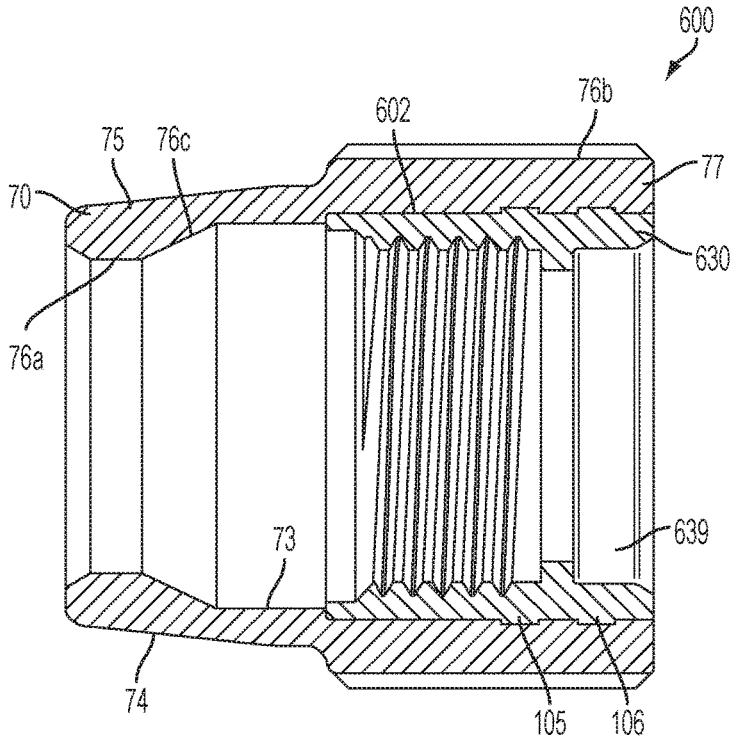
FIG. 20A depicts a cross-sectional view of a second embodiment of a connector seal device in an assembled position.
Figure 20B:
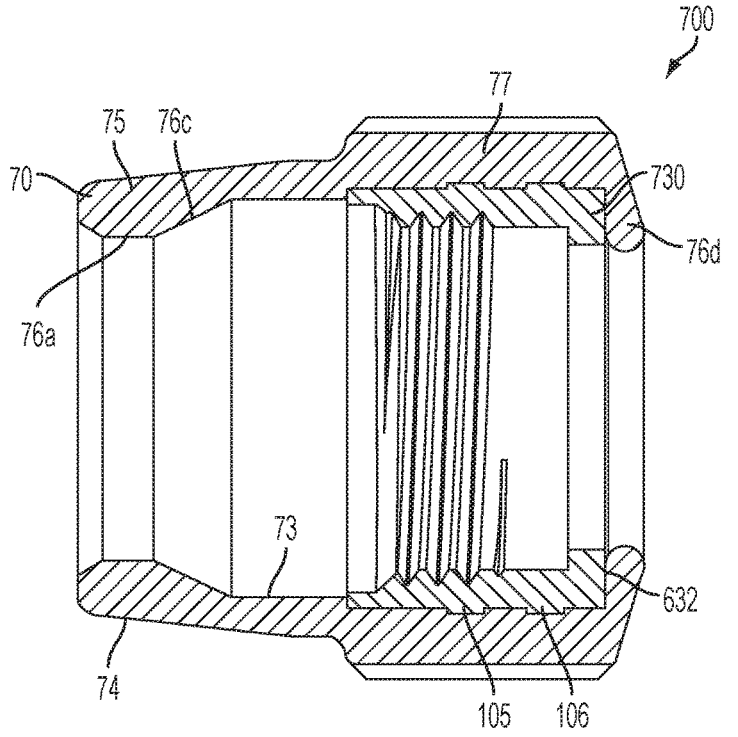
FIG. 20B depicts a cross-sectional view of a third embodiment of a connector seal device in an assembled position.

In reference to FIGS. 20A-20B, there is depicted more embodiments of a coupler-seal assembly 600, 700, respectively, including a unitary connector seal device 70 which forms an environmental seal with coupling member 630, 730, respectively. Certain features of the coupler-seal assemblies 600, 700 are not enumerated for purposes of clarity in the figures. Those features not enumerated in FIGS. 20A-20B may be understood by reference to the description of the embodiments of FIGS. 1A and 3A-3C which have similar features. With reference to FIG. 20A, the coupling member 630 and the seal device 70 each include an axial opening formed therethrough. The seal device 70 may be formed or molded onto the coupling member 630 such as by injection molding the liquefied material of the seal device 70 at a raised temperature which forms the seal device 70 as a unitary structure. As the material of the seal device 70 cools, it shrinks, tightens and compresses radially inward against the coupling member 630 to form a mechanical bond and an environmental seal therewith.

In one embodiment, the seal device 70 may comprise silicone rubber and exhibit properties that enhance manual manipulation of seal device 70 such as gripping the seal device 70 to rotate it, thereby also rotating the coupling member 630. The material of the seal device 70 incorporate a depressible, grip or tactile characteristic which facilitates the hand rotation of the coupler 630 by grasping the seal device 70 by hand. An annular cavity 639 proximate the rearward end of the coupling member 630 is configured to receive an O-ring for forming an environmental seal with a cable connector inserted therein.

In this embodiment, seal device 70 is formed over the entire exterior surface 602 of the coupling member 630. Coupling member 630 includes surface irregularities 105, 106 on its exterior surface 602, as described herein, which may include protrusions, grooves, teeth, detents, ridges, sharp points, or combinations thereof, to establish a secure connection to the seal device 70 so as to prevent axial and angular displacement of the coupling member 630 relative to the seal device 70, in particular when the seal device 70 is being manipulated such as by manual rotation. The rearward portion of the seal device 70 comprises a retention portion 76*b* or mating portion, for coupling with the coupling member 630. An interior facing surface 73 of the retention portion 76*b* of the seal device 70 may include surface irregularities which mate with, and correspond to, the irregularities 105, 106, on the exterior surface 602 of the coupling member 630 so as to form a mating engagement therebetween.

Referring to FIGS. 1A-1B and 20A, the seal device 70 has a seal neck 75 which faces in the forward direction 17. The seal neck 75 may flexibly expand to fit around an interface port, such as interface port 20, and form an environmental seal therewith. The seal neck 75 includes an inner protrusion 76*a* on its interior surface 73. The inward protrusion 76*a* provides a tapered surface for enhancing a sealing engagement with the outer surface 24 of the interface port 20 to form a more secure environmental seal. In operation, the installer slides the seal neck 75 onto the outer surface 24 while the seal neck radially expands. The seal neck, due to its elasticity, applies a radial force onto the surface 24 of the port 20, forming one environmental seal. Depending upon the embodiment, the forward end of the seal neck 75 may abut the port wall or port housing 200 to form another environmental seal. Embodiments of coupling member 630 may share the same structural and functional aspects as coupling member 30 described herein with reference to FIGS. 1 and 3A-3C.

With reference to FIG. 20B, the coupler-seal assembly 700 shares most of the physical features and functions described herein with respect to the embodiment of FIG. 20A, except that the seal device 70 comprises a rearward, annular sealing portion 76*d* in the form of an extended flexible lip formed over a rearward facing surface 632 of the coupling member 630. Also in this embodiment, a rearward portion of the coupling member 630 is shortened to remove the cavity 639 that was configured to receive an O-ring in the embodiment of FIG. 20A. The rearward annular sealing portion 76*d*, integral with the seal device 70, serves as an effective O-ring by engaging an exterior surface of the connector body 50 when the connector is assembled. The rearward sealing portion 76*d* thereby forms an environmental seal with the connector body 50 by radially pressing against the connector body 50 when the connector body is partially inserted into the coupling member 630 through the rearward end thereof, during assembly. In this assembled position (see e.g. FIG. 23D) a portion of the connector body 50 is received by the rearward sealing portion 76*d* when the connector body 50 is partially inserted therethrough.

Figure 21A:
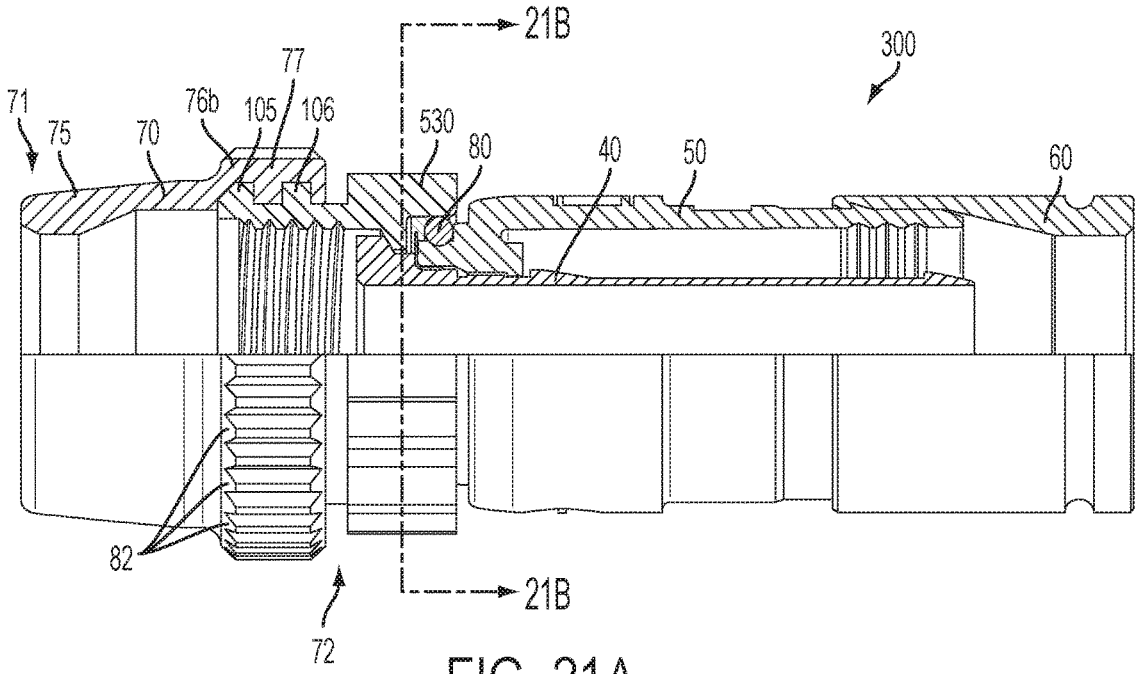
FIG. 21A depicts a quarter-sectional view of an embodiment of a cable connector in an assembled position.
Figure 21B:
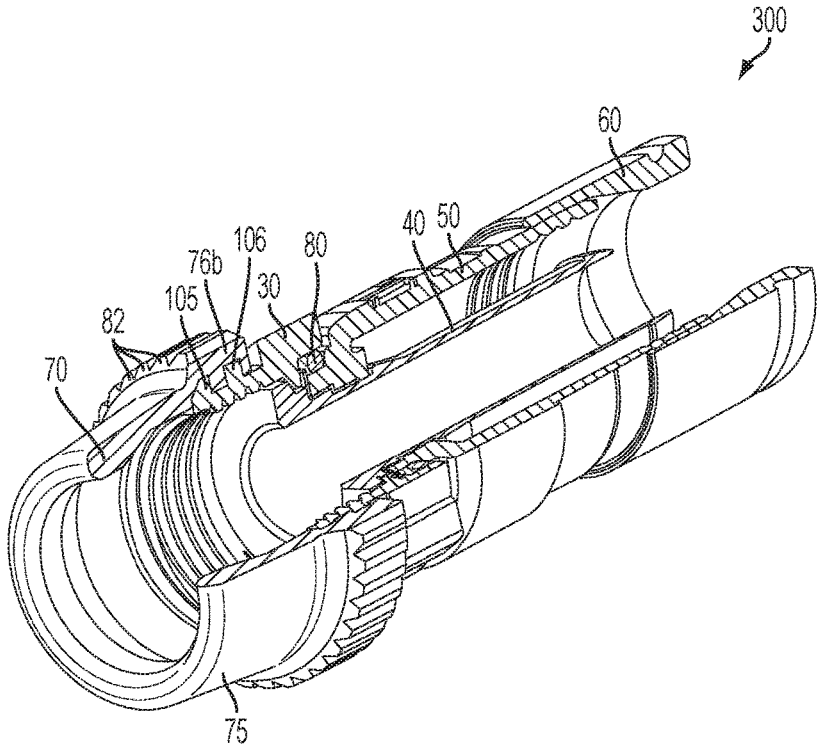
FIG. 21B depicts a perspective view of the cable connector embodiment depicted in FIG. 21A.
Figure 21C:
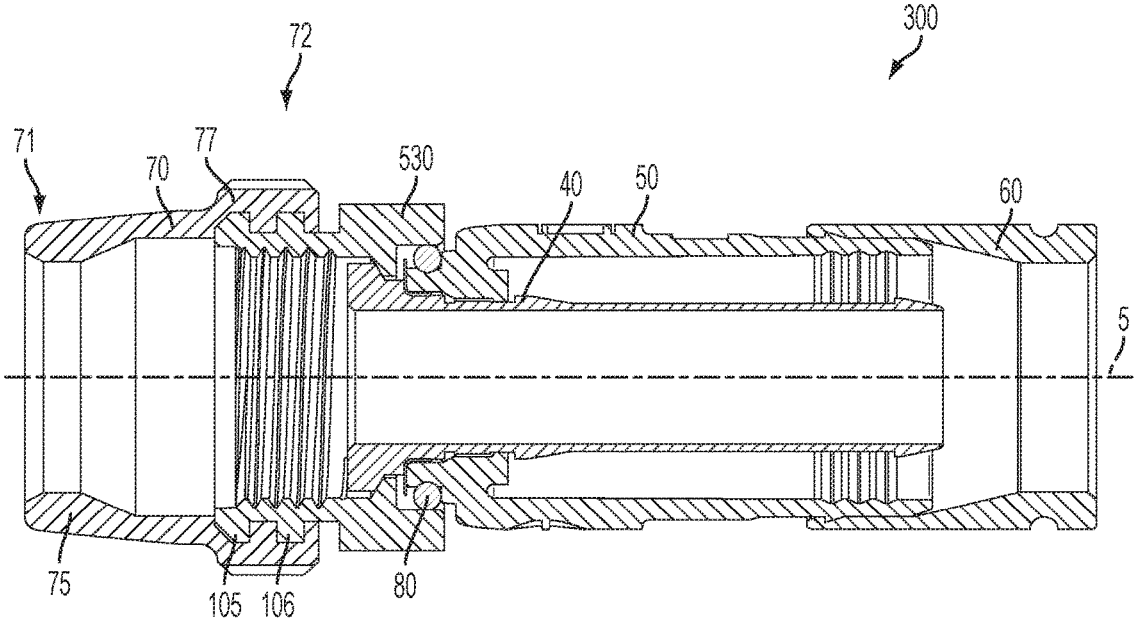
FIG. 21C depicts cross-sectional view of the cable connector embodiment depicted in FIG. 21A.

With reference to FIGS. 21A-21C, a coaxial cable connector 300 is illustrated. The cable connector 300 comprises a coupling member 530, as described herein with reference to FIGS. 16-19, having irregularities 105, 106, a seal device 70, an O-ring 80, a post 40, a connector body 50, and compression ring or fastener member 60, each comprising functional structures cooperating as variously described herein in the several disclosed embodiments which may be usable in combination. The cable connector 300 comprises an O-ring 80 disposed between the coupling member 530 and connector body 50 to form an environmental seal therebetween. The coupling member 530 is rotatably coupled to the connector body 50 to allow rotation of the coupler-seal assembly formed by seal device 70 and coupling member 530.

The seal neck 75 and seal body 77 are integral portions of the unitary structure of the seal device 70. The forward end 71 of the seal neck 75 faces in a forward direction, and the rearward end 72 of the seal body 77 faces in a rearward direction.

As can be seen in FIG. 21A, the seal device 70 includes one or more surface irregularities 82 on the exterior surface of the retention portion 76*b* of the seal device 70. The surface irregularities 82 are in the form of a plurality of ridges generally aligned in parallel with a longitudinal axis of the connector 300. These irregularities 82 facilitate manually grasping and rotating the seal device 70 together with the coupling member 530.

Figure 22A:
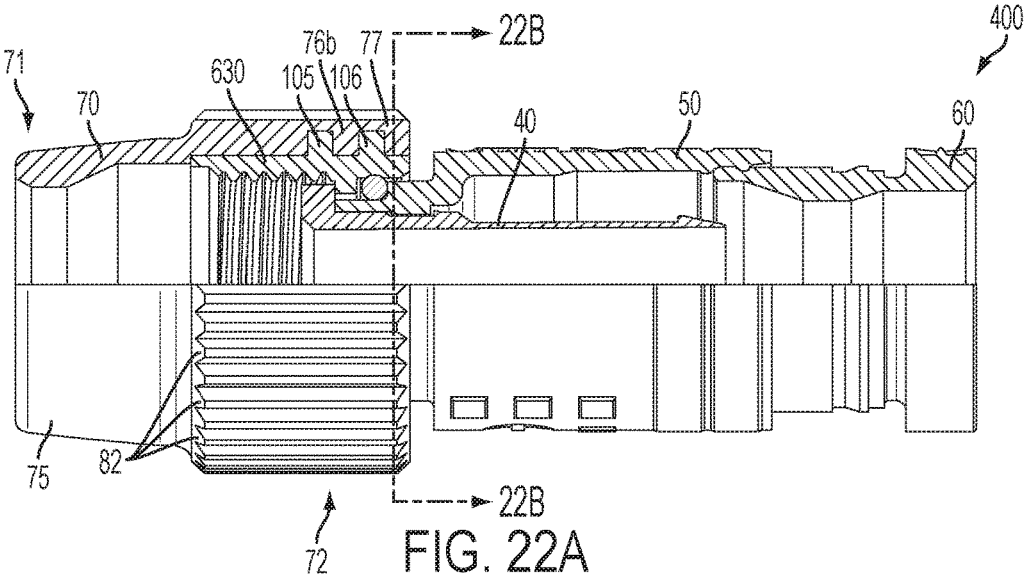
FIG. 22A depicts a quarter-sectional view of another embodiment of a cable connector in an assembled position.
Figure 22B:
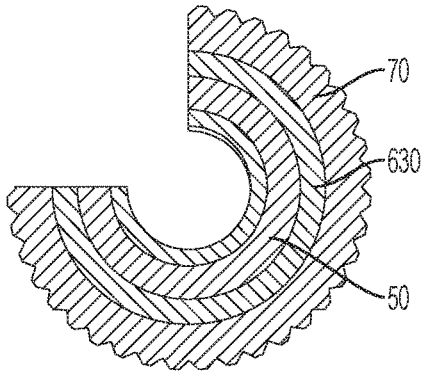
FIG. 22B depicts an end-view cross-section of the cable connector embodiment depicted in FIG. 22A.
Figure 22C:
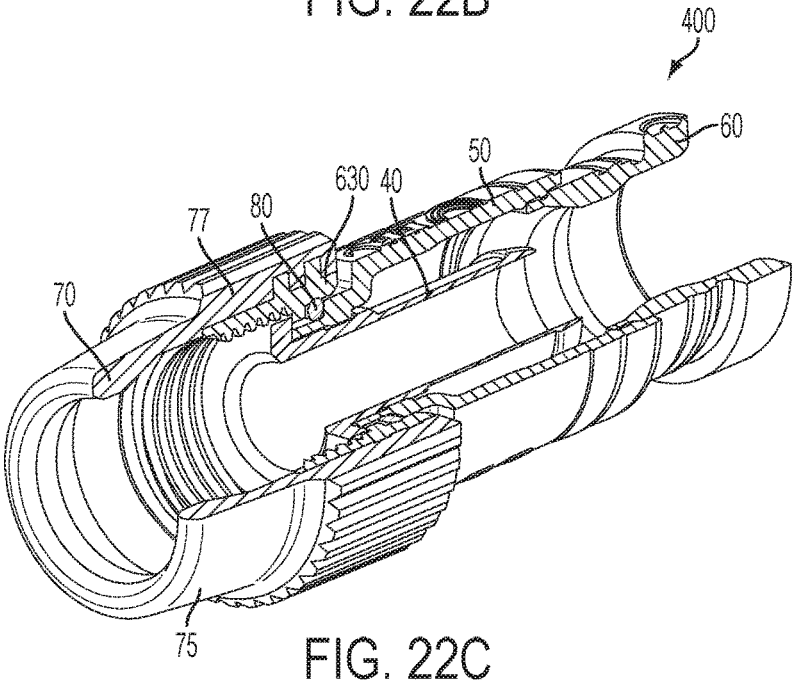
FIG. 22C depicts a perspective view of the cable connector embodiment depicted in FIG. 22A.
Figure 22D:
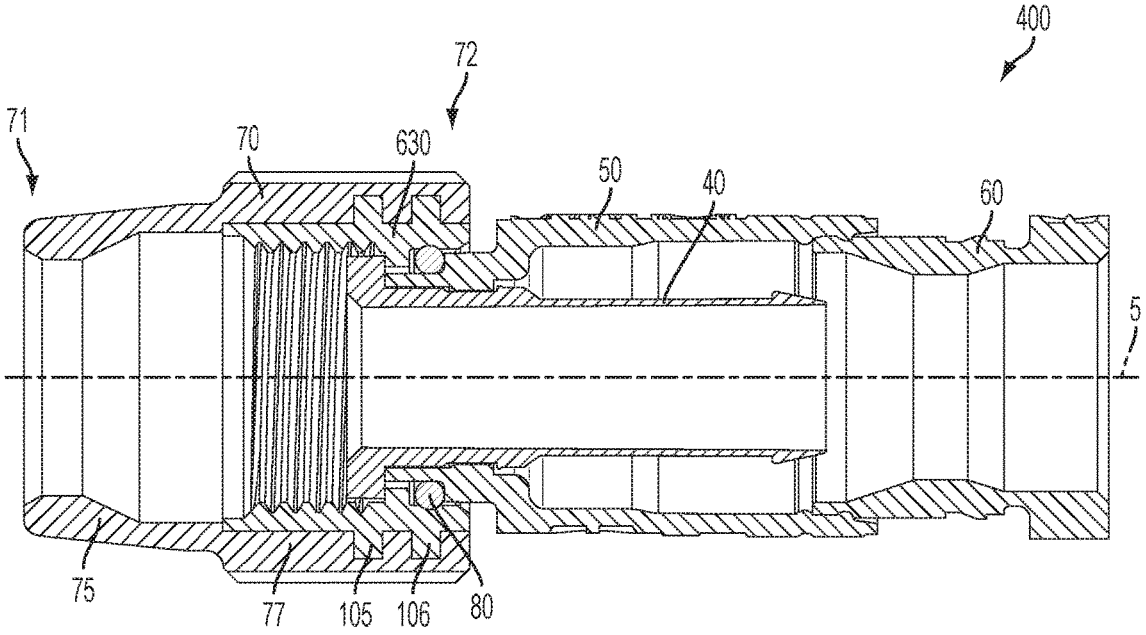
FIG. 22D depicts cross-sectional view of a the cable connector embodiment depicted in FIG. 22A.

With reference to FIGS. 22A-22D, coaxial cable connector 400 is illustrated. The cable connector 400 comprises a coupling member 630, as described herein with reference to FIG. 20A, having irregularities 105, 106, a seal device 70, an O-ring 80, a post 40, a connector body 50, and compression ring or fastener member 60, each comprising functional structures cooperating as variously described herein in the several disclosed embodiments which may be usable in combination. The cable connector 400 comprises an O-ring 80 disposed between the coupling member 630 and connector body 50 to form an environmental seal therebetween. The coupling member 530 is rotatably coupled to the connector body 50 to allow rotation of the coupler-seal assembly formed by seal device 70 and coupling member 630. As can be seen in FIG. 22A, the seal device 70 includes surface irregularities 82 on the exterior surface of the retention portion 76*b* of the seal device 70. The surface irregularities 82 are in the form of a plurality of ridges generally aligned in parallel with a longitudinal axis of the connector 400. These irregularities 82 provide additional facilitation for manually grasping and rotating the seal device 70 together with the coupling member 630. As illustrated in the end-view cross-section of the cable connector 400 shown in FIG. 22B, the coupling member 630 comprises a circular cross-section. Thus, the coupling member 630 need not be shaped in a form having an exterior surface with a planar portion, such as in a hexagonal profile (e.g. FIG. 4).

The seal neck 75 and seal body 77 are integral portions of the unitary structure of the seal device 70. The forward end 71 of the seal neck 75 faces in a forward direction, and the rearward end 72 of the seal body 77 faces in a rearward direction.

Figure 23A:
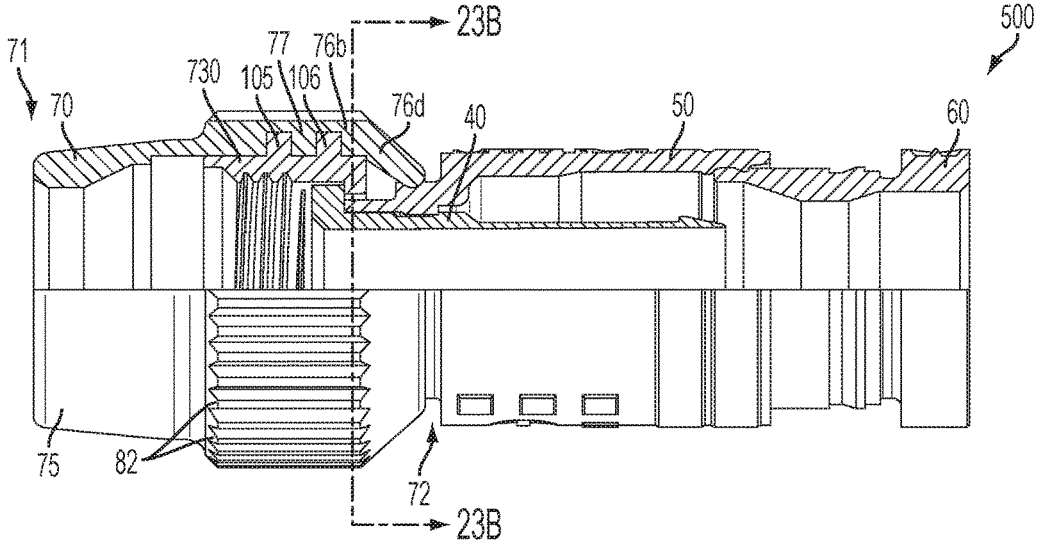
FIG. 23A depicts a quarter-sectional view of yet another embodiment of a cable connector in an assembled position.
Figure 23B:
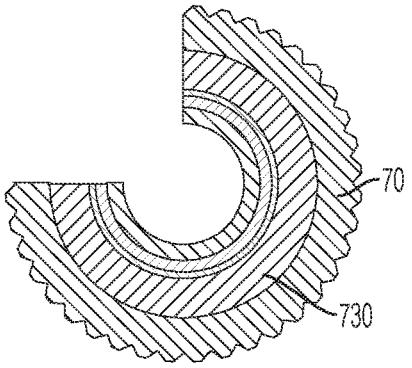
FIG. 23B depicts an end-view cross-section of the cable connector embodiment depicted in FIG. 23A.
Figure 23C:
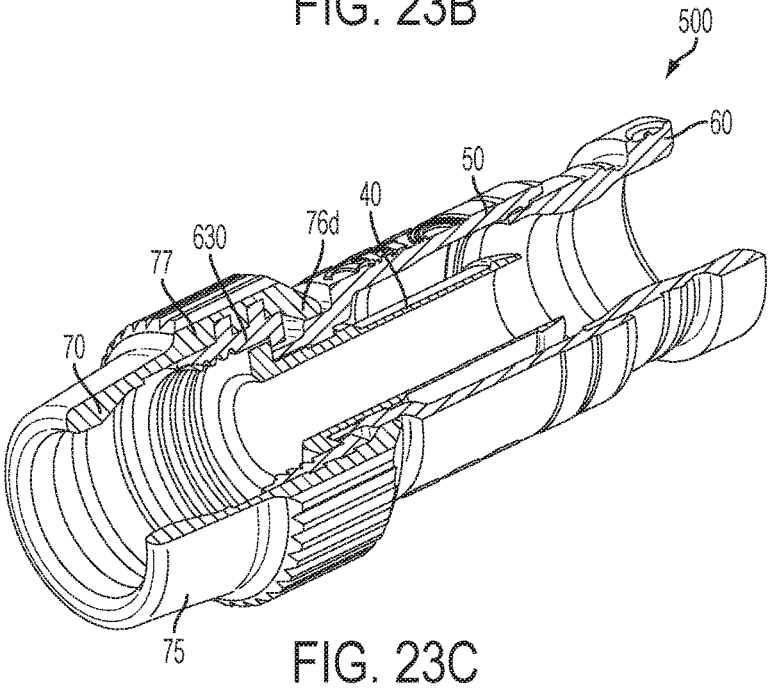
FIG. 23C depicts a perspective view of the cable connector embodiment depicted in FIG. 23A.
Figure 23D:
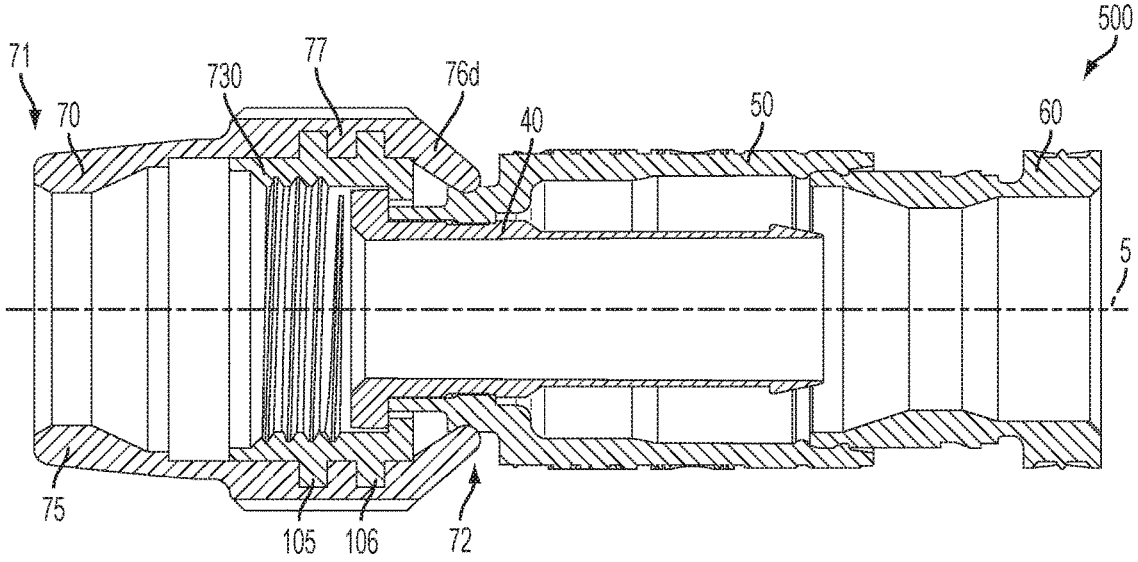
FIG. 23D depicts cross-sectional view of the cable connector embodiment depicted in FIG. 23A.

With reference to FIGS. 23A-23D, coaxial cable connector 500 is illustrated. The cable connector 500 comprises a coupling member 730, as described herein with reference to FIG. 20B, having irregularities 105, 106, a seal device 70, a post 40, a connector body 50, and compression ring or fastener member 60, each comprising functional structures cooperating as variously described herein in the several disclosed embodiments which may be usable in combination. The cable connector 500 comprises a seal device 70 having a rearward sealing portion 76*d* in the form of a flexible extended lip 76*d* radially engaging the connector body 50 to form an environmental seal therewith. In this embodiment, the flexible extended lip 76*d* extends over the rearward end of the coupling member 730 at an inward angle toward the axis 5 of the cable connector 500. The coupling member 730 is rotatably coupled to the connector body 50 to allow rotation of the coupler-seal assembly formed by seal device 70 and coupling member 730. As can be seen in FIG. 23A, the seal device 70 includes surface irregularities 82 on the exterior surface of the retention portion 76*b* of the seal device 70. The surface irregularities 82 are in the form of a plurality of ridges generally aligned in parallel with a longitudinal axis of the connector 500. These irregularities 82 provide additional facilitation for manually grasping and rotating the seal device 70 together with the coupling member 730. As illustrated in the end-view cross-section of the cable connector 500 shown in FIG. 23B, the coupling member 730 comprises a circular cross-section. Thus, the coupling member 730 need not be shaped in a form having an exterior surface with a planar portion, such as in a hexagonal profile (e.g. FIG. 4).

The seal neck 75 and seal body 77 are integral portions of the unitary structure of the seal device 70. The forward end 71 of the seal neck 75 faces in a forward direction, and the rearward end 72 of the seal body 77 faces in a rearward direction.

Figure 24:
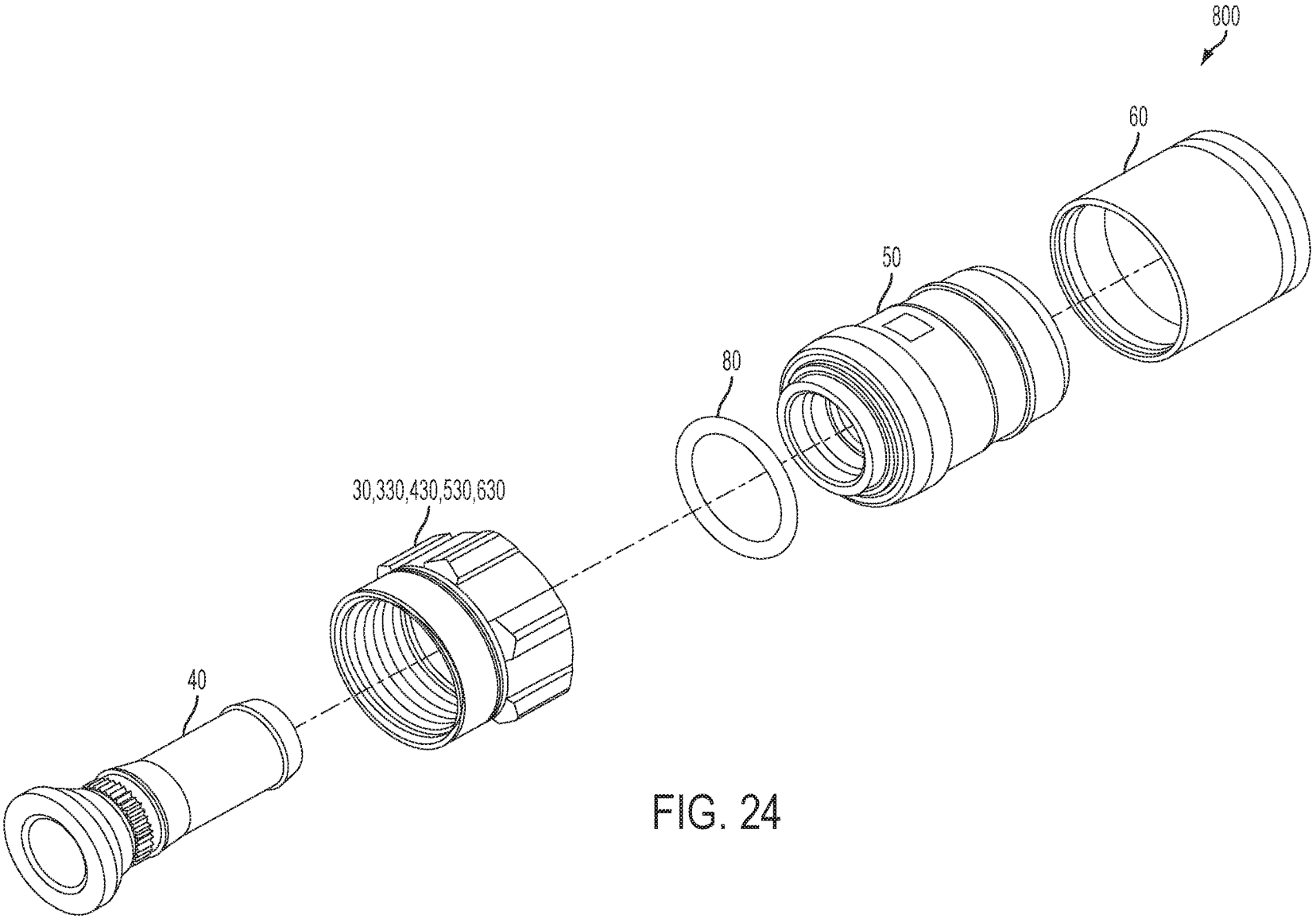
FIG. 24 depicts an exploded view of yet another cable connector embodiment.

With reference to FIG. 24, there is illustrated an cable connector 800 in exploded perspective view. As described herein, the cable connector 800 includes a post 40 that is inserted through an axial opening in each of a coupling member (30, 330, 430, 530, 630), an O-ring 80, connector body 50, and compression ring or fastener member 60. Although the coupling member (30, 330, 430, 530, 630) is illustrated in the form of the embodiment 530 described herein with reference to FIGS. 16-19, the coupling member may include the various embodiments 30, 330, 430, 530, 630 of coupling members described herein.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A connector seal device comprising:

a coupler configured to be rotatably coupled to a connector body of a coaxial cable connector; and a unitary structure mated with the coupler so as to resist relative axial and rotational movement between the unitary structure and the coupler, the unitary structure including:

a seal body extending along an axis, the seal body being configured to receive the coupler and to apply a radial force to the coupler so as to establish a first environmental seal between the seal body and the coupler, and a seal neck configured to extend from the seal body along the axis beyond an end of the coupler, the seal neck being configured to engage an interface port so as to establish a second environmental seal between the seal neck and the interface port, wherein the unitary structure is configured to partially receive a connector body of the coaxial cable connector, the unitary structure being configured to engage the connector body so as to establish a third environmental seal between the unitary structure and the connector body.

2. The connector seal device of claim 1, wherein the seal neck includes a flexible interior surface having a radially-inward extending protrusion configured to mechanically engage the interface port.

3. The connector seal device of claim 2, wherein the unitary structure includes an integral joint-section having a tapered radial cross-section, the integral joint-section being configured to encourage an outward expansion or bowing of the unitary structure upon axial compression of the unitary structure.

4. The connector seal device of claim 3, wherein the integral joint-section is between the radially-inward extending protrusion and the end of the coupler.

5. The connector seal device of claim 1, wherein the seal body is configured to cover and engage an entire exterior surface of the coupler.

6. The connector seal device of claim 1, wherein the end of the coupler includes surface features having gaps therebetween, and wherein the seal body is configured to fill the gaps between the surface features to establish the first environmental seal.

7. A connector seal device comprising:

a seal body having a unitary structure; and a coupler having a first end configured to be coupled with a coaxial cable interface port and a second end configured to receive a connector body of a coaxial cable connector, the coupler being configured to be coupled with and to rotate relative to the connector body, wherein the coupler includes a first retention portion configured to mate with a second retention portion of the seal body so as to resist relative axial and rotational movement between the seal body and the coupler, wherein the seal body is configured to extend along an axis and receive the coupler therein, wherein the seal body is configured to apply a radial force to the coupler so as to establish a first environmental seal between the seal body and the coupler, wherein the seal body includes a forward sealing portion configured to extend beyond the first end of the coupler, the forward sealing portion being configured to engage the coaxial cable interface port so as to establish a second environmental seal between the forward sealing portion and the coaxial cable interface port, and wherein the seal body includes a rearward sealing portion configured to extend beyond the second end of the coupler, the rearward sealing portion being configured to engage the connector body so as to establish a third environmental seal between the rearward sealing portion and the connector body.

8. The connector seal device of claim 7, wherein the forward sealing portion includes a flexible interior surface having a radially-inward extending protrusion configured to mechanically engage the interface port.

9. The connector seal device of claim 7, wherein the forward sealing portion includes an integral joint-section having a tapered radial cross-section, the integral joint-section being configured to encourage an outward expansion or bowing of the seal body upon axial compression of the seal body.

10. The connector seal device of claim 7, wherein the seal body is configured to cover and engage an entire exterior surface of the coupler.

11. The connector seal device of claim 7, wherein the first end of the coupler includes surface features having gaps therebetween, and wherein the seal body is configured to fill the gaps between the surface features to establish the first environmental seal.

12. The connector seal device of claim 7, wherein the first retention portion and the second retention portion are configured to mechanically bond with each other.

13. The connector seal device of claim 7, wherein the first retention portion and the second retention portion are configured to interlock with each other.

14. A connector seal device comprising:

a seal portion having a unitary structure; and a coupler portion having a first end configured to be coupled with a coaxial cable interface port and a second end configured to receive a connector body portion of a coaxial cable connector, the coupler portion being configured to be coupled with and to rotate relative to the connector body portion, wherein the coupler portion is configured to mate with the seal portion so as to resist relative axial and rotational movement between the seal portion and the coupler portion, wherein the seal portion is configured to extend along an axis and receive the coupler portion therein, wherein the seal portion is configured to establish a first environmental seal between the seal portion and the coupler portion, wherein the seal portion includes a forward sealing portion configured to extend beyond the first end of the coupler portion, the forward sealing portion being configured to establish a second environmental seal between the forward sealing portion and the coaxial cable interface port, and wherein the seal portion includes a rearward sealing portion configured to extend beyond the second end of the coupler portion, the rearward sealing portion being configured to establish a third environmental seal between the rearward sealing portion and the connector body portion.

15. The connector seal device of claim 14, wherein the forward sealing portion includes a flexible interior surface having a radially-inward extending protrusion configured to mechanically engage the interface port.

16. The connector seal device of claim 14, wherein the forward sealing portion includes an integral joint-section having a tapered radial cross-section, the integral joint-section being configured to encourage an outward expansion or bowing of the seal portion upon axial compression of the seal portion.

17. The connector seal device of claim 14, wherein the seal portion is configured to cover and engage an entire exterior surface of the coupler portion.

18. The connector seal device of claim 14, wherein the first end of the coupler portion includes surface features having gaps therebetween, and wherein the seal portion is configured to fill the gaps between the surface features to establish the first environmental seal.

19. The connector seal device of claim 14, wherein the seal portion and the coupler portion are configured to mechanically bond with each other.

20. The connector seal device of claim 14, wherein the seal portion and the coupler portion are configured to interlock with each other.

* * * * *